US008514170B2

(12) United States Patent
Brewer et al.

(10) Patent No.: US 8,514,170 B2
(45) Date of Patent: Aug. 20, 2013

(54) MAGNETIC DISPLAY FOR WATCHES

(75) Inventors: Donald R. Brewer, Richardson, TX (US); David B. Cope, Medfield, MA (US); Andrew M. Wright, Cambridge, MA (US); Christopher J. Corcoran, Newton, MA (US)

(73) Assignee: Art Technology Inc., Dallas, TX (US)

( * ) Notice: Subject to any disclaimer, the term of this patent is extended or adjusted under 35 U.S.C. 154(b) by 1613 days.

(21) Appl. No.: 11/904,398

(22) Filed: Sep. 27, 2007

(65) Prior Publication Data

US 2008/0084381 A1 Apr. 10, 2008

Related U.S. Application Data

(60) Provisional application No. 60/906,789, filed on Mar. 13, 2007, provisional application No. 60/847,787, filed on Sep. 27, 2006.

(51) Int. Cl.
*G09G 3/34* (2006.01)

(52) U.S. Cl.
USPC ..... 345/111; 345/33; 345/34; 345/108; 40/446; 40/449; 40/450; 40/492; 340/815.44; 340/815.54; 340/815.64; 340/815.71

(58) Field of Classification Search
USPC ..... 345/108–111, 33, 34; 40/449, 446, 40/447, 492, 450, 452, 451; 340/815.24–815.27, 815.54, 815.64, 815.71
See application file for complete search history.

(56) References Cited

U.S. PATENT DOCUMENTS

| | | | | |
|---|---|---|---|---|
| 3,025,512 | A | 3/1962 | Bloechl | |
| 3,096,594 | A | 7/1963 | Skrobisch | |
| 3,134,062 | A * | 5/1964 | Held | 318/128 |
| 3,365,824 | A | 1/1968 | Winrow | |
| 3,668,700 | A * | 6/1972 | Skrobisch | 340/815.44 |
| 3,712,046 | A | 1/1973 | Dill | |
| 4,006,476 | A | 2/1977 | Romney | |
| 4,040,193 | A | 8/1977 | Matsuda et al. | |

(Continued)

FOREIGN PATENT DOCUMENTS

| | | |
|---|---|---|
| CH | 200780043623.5 | 6/2011 |
| EP | 1 471 487 A1 | 10/2004 |

(Continued)

OTHER PUBLICATIONS

PCTUS0820845, Search Report.

(Continued)

*Primary Examiner* — Kevin M Nguyen
*Assistant Examiner* — Jennifer Nguyen
(74) *Attorney, Agent, or Firm* — Arthur J. Usher, IV

(57) ABSTRACT

A smaller sized flip dot display utilizes a magnetically actuated pixel that rotates between two orientations. The orientations display two different optical states. A simulated dot matrix design improves the aesthetics and consumer appeal, and also permits a flip dot display capable of producing a positive contrast display image with darker colored "ON" pixels contrasting with brighter background and "OFF" pixels by reducing the visibility of the spacing gap between each rotating pixel and the surrounding background. An interwoven configuration of magnetic actuators with a coil around each arm of a U-shaped core may result in lower power consumption, low production cost, and small size required for use in consumer and small mobile devices such as watches and mobile phones.

41 Claims, 12 Drawing Sheets

(56) References Cited

U.S. PATENT DOCUMENTS

| | | | | |
|---|---|---|---|---|
| 4,070,668 | A * | 1/1978 | Kawaharada et al. | 340/815.44 |
| 4,077,032 | A * | 2/1978 | Volkman | 368/29 |
| 4,274,153 | A | 6/1981 | Kume et al. | |
| 4,295,127 | A * | 10/1981 | Sautter et al. | 340/815.62 |
| 4,527,096 | A | 7/1985 | Kindlmann | |
| 4,577,427 | A | 3/1986 | Browne | |
| 4,627,182 | A | 12/1986 | Weiss | |
| 4,744,163 | A | 5/1988 | Browne et al. | |
| 5,005,305 | A | 4/1991 | Turney et al. | |
| 5,088,073 | A | 2/1992 | Speas | |
| 5,307,520 | A | 4/1994 | Oyamada et al. | |
| 5,481,816 | A * | 1/1996 | Cobb et al. | 40/450 |
| 5,577,336 | A * | 11/1996 | Jensen | 40/450 |
| 5,793,343 | A | 8/1998 | Hart et al. | |
| 5,901,483 | A * | 5/1999 | Tijanic | 40/449 |
| 5,936,523 | A | 8/1999 | West | |
| 5,977,688 | A | 11/1999 | Utsunomiya et al. | |
| 6,229,517 | B1 * | 5/2001 | Enz | 345/108 |
| 6,272,778 | B1 * | 8/2001 | Tang | 40/449 |
| 6,278,431 | B1 | 8/2001 | Kao | |
| 6,510,632 | B1 | 1/2003 | Weinacht et al. | |
| 6,894,952 | B2 | 5/2005 | Morokawa et al. | |
| 7,176,887 | B2 | 2/2007 | Marvit et al. | |
| 7,394,726 | B2 | 7/2008 | O'Neill et al. | |
| 7,701,807 | B2 | 4/2010 | Kitazawa et al. | |
| 2003/0198141 | A1 | 10/2003 | Brewer et al. | |
| 2004/0166966 | A1 | 8/2004 | Nielsen | |
| 2006/0020469 | A1 | 1/2006 | Rast | |
| 2008/0151700 | A1 * | 6/2008 | Inoue et al. | 368/80 |
| 2009/0009465 | A1 | 1/2009 | Choi et al. | |

FOREIGN PATENT DOCUMENTS

| | | | |
|---|---|---|---|
| JP | 7 005826 | A | 1/1995 |
| WO | WO 2008/039511 | A2 | 4/2008 |
| WO | WO 2008/039511 | A3 | 4/2008 |
| WO | WO 2008/039955 | A2 | 4/2008 |

OTHER PUBLICATIONS

PCT/US2009/002066, Search Report (SR).
PCT/US2007/020845, Supp SR/Written Opinion.
PCT/US2009/002066, Supp EP Search Report.
Office Action (non-final rejection) in U.S. Appl. No. 12/891,453 mailed Apr. 10, 2012.

* cited by examiner

MAGNETIC DISPLAY FOR WATCHES

CROSS-REFERENCE TO RELATED APPLICATIONS

This application claims priority to and the benefit of U.S. Provisional Patent Application No. 60/906,789 entitled "Magnetic Display For Watches" filed 13 Mar. 2007, and also claims priority to and the benefit of U.S. Provisional Patent Application No. 60/847,787 entitled "Magnetic Display For Watches" filed 27 Sep. 2006.

BACKGROUND OF THE INVENTION

Large scale flip dot displays are operated utilizing a matrix of rotatable pixels, each pixel having a permanent magnet. Current passes through an underlying electromagnet and generates a magnetic field that rotates the pixel up to 180 degrees to display one of two sides. Disadvantages of this type of display technology have prevented its usage much beyond large, outdoor signage. For example, flip dot displays require high voltage to actuate rotation of a pixel, usually not less than 18-32 volts with corresponding significant current consumption. Flip dot displays are also quite expensive per pixel, and has only been commercialized in very large segment sizes. Due to these power, size, and cost limitations the prior art and industrial applications of flip dot displays have focused solely on large, outdoor signage applications. Furthermore, present flip dot displays typically have a standard industrial look featuring a green, yellow, or white painted coating on one side of the pixel representing its "ON" optical state. The "ON" optical state has a high contrast and visibility against the matte black painted background or opposing side of the pixel representing the "OFF" optical state.

In a variety of consumer electronics products ranging from digital watches, clocks, and mobile phones the dull black-on-grey liquid crystal display (LCD) is predominant. Many manufacturers find that their target price points suffer in higher-end products due to the perceived lower value and design limitations of this dull looking display. In product categories such as watches, function has become less of a differentiator. Design manufacturers instead rely on the use of differing materials to convey value. A colored plastic band or watch case may be used in a low-end watch, while a metal case and leather band would be found in higher priced watches.

SUMMARY OF THE INVENTION

In one embodiment of the present invention there is a mobile display apparatus that comprises an array of rotatable pixels that provide information. One portion of each rotatable pixel includes a permanent magnet, and each pixel rotates between a first orientation to present a first display face with a first optical state, and a second orientation to present a second display face having a second optical state. The first optical state is different from the second optical state in that some of the pixels are adjacent to a background that matches one of the first optical state and the second optical state. The watch also has a means for magnetically rotating the array of rotatable pixels. A battery is electrically connected to the means for magnetically rotating.

In one refinement the mobile display apparatus is a cell phone and the information provided includes alphanumeric digits, particularly phone numbers or caller identification information.

In another refinement the mobile display apparatus is a timepiece (such as a watch or a small clock) and the information is chronological information. In a further refinement the chronological information might only include date information. In yet a further refinement the chronological information might only includes time information. Also, the chronological information might include some combination of date and time information In another refinement the means for magnetically rotating the array of rotatable pixels includes a plurality of electromagnets. Each of the electromagnets have a U-shaped core defined by a base portion. The base portion connects a first arm and a second arm. The first arm includes a first coil, and the second arm includes a second coil.

In another refinement the background includes a plurality of simulated dot matrix panels and grooves between at least some of the panels that are adjacent to each other. Each groove substantially mimics a gap between at least one of the rotatable pixels and the background.

In another refinement the background is a repeating dot matrix pattern. Each dot matrix panel includes an attached material selected from the group comprising crystal, gemstone, or metal.

In another refinement the attached material on one panel includes a rhinestone, and the attached material on another panel includes crystal.

In another refinement a dot matrix panel is present on at least one of the first display face and the second display face of at least one of the array of rotatable pixels.

In another refinement each groove is a dark line.

In another refinement each pixel rotates between a first orientation with an off optical state that substantially matches the panels around that pixel, and a second orientation with an on optical state that differs from the panels around that pixel.

In another refinement at least one rotatable pixel in an off optical state includes a plurality of panes, each pane being substantially the same size as the simulated dot matrix panels.

In another refinement the display is a positive contrast display. An on optical state of at least one rotatable pixel is darker than the surrounding panels of the background.

In another refinement at least one of the display faces of at least one of the array of rotatable pixels includes an attached material selected from the group comprising rhinestone, crystal, diamond, or metal.

In another refinement an analog movement with watch hands are positioned above the background and the array of pixels.

In another refinement a first group of pixels in the array of pixels are in a first plane. A second group of pixels in the array of pixels are in a second plane. The first plane and the second plane are different.

In another refinement at least one of the first display face and the second display face of at least one pixel includes a coating consisting of a phosphorescent coating or a fluorescent coating.

In another refinement there further comprises a case having at least a partially hollow interior. The background and the array of rotatable pixels are positioned within the interior of the case. A LED front light is positioned within the case to shine light onto at least a portion of the background and the array of pixels.

In another refinement the LED emits some portion of light in the ultraviolet wavelengths.

In another refinement each pixel includes a stop protruding from a side of the pixel. The stop is substantially hidden beneath the background.

In another refinement the pixel rotates approximately 180 degrees.

In another refinement a first group of the array of pixels are configured to display an alphanumeric character. The means for magnetically rotating the array of rotatable pixels controls rotation of the first group. Each rotatable pixel of the first group is rotated by a U-shaped core having two arms that each have at least one coil. The U-shaped cores are configured beneath the first group to minimize magnetic interference between the coils and permanent magnets of the first group of rotatable pixels.

In another embodiment of the present invention a mobile apparatus display comprises a plurality of magnetically actuated rotatable pixels positioned within a background. The background includes a plurality of simulated dot matrix panels and a plurality of grooves between at least some of the adjacent panels. Each groove substantially mimics a gap between at least one of the rotatable pixels and the background.

In one refinement of the present invention the mobile apparatus display is a cell phone display or a timepiece display. The timepiece might be a clock or a watch.

In another refinement of the present invention the groove is a cutout portion between adjacent simulated dot matrix panels.

In another refinement the groove is a dark line.

In another refinement each pixel rotates between a first orientation with an off optical state that substantially matches the panels around that pixel, and a second orientation with an on optical state that differs from the panels around that pixel.

In another refinement at least one rotatable pixel in the off optical state includes a plurality of panes. Each pane is substantially the same size as the simulated dot matrix panels.

In another refinement at least a portion of the display is a positive contrast display. An on optical state of at least one rotatable pixel is darker than the surrounding panels of the background.

In another refinement a first portion of the display is a positive contrast display. A second portion of the display is a negative contrast display.

In another refinement at least some of the panels have different colors.

In another refinement all of the display is a positive contrast display.

In another refinement the display further comprises means for magnetically rotating the plurality of rotatable pixels. At least a portion of each pixel includes a permanent magnet. The means for magnetically rotating includes a plurality of electromagnets. Each electromagnet corresponding to one pixel and having a U-shaped core defined by a base portion connecting a first arm and a second arm. The first arm includes a first coil and the second arm includes a second coil.

In another refinement at least one of the rotatable pixels includes a display face having an attached material selected from the group consisting of crystal, gemstone, or metal.

In another embodiment of the present invention there is a mobile apparatus display comprising a plurality of magnetically actuated rotatable pixels. Each pixel has a permanent magnet that rotates between a first orientation and a second orientation. The two orientations have different optical states. The rotatable pixels are set against a repeating dot matrix pattern having a plurality of panels. The spacing between the panels substantially matches the spacing between the pixels and surrounding background.

In one refinement of the present invention the mobile apparatus display is a cell phone display or a timepiece display. The timepiece might be a clock or a watch.

In another refinement of the present invention there are a plurality of electromagnets. Each electromagnet is positioned beneath a corresponding pixel substantially adjacent to the permanent magnet so that current that magnetizes the electromagnet oppositely to the polarity of the permanent magnet causes a rotation of the pixel from one of the first orientation and the second orientation to the other of the first orientation and the second orientation;

In another refinement the electromagnet includes a U-shaped core oriented perpendicular to the axle with at least one pole located in proximity to the permanent magnet of the pixel.

In another refinement at least one of the electromagnets has a U-shaped core, and there is a first coil around a first arm of the core and a second coil around a second arm of the core.

In another refinement the resistance of each coil is greater than 75 Ohms.

In another refinement the pixel has at least two panes incorporated on one of its optical states, and there is a groove between the two panes that substantially matches the spacing between the pixel and the background.

In another refinement the groove is a dark line that provides an appearance closely matching a gap between each pixel and the surrounding background.

In another refinement a display face of at least one of the pixels includes an attached material selected from the group consisting of crystals, gemstones, or metals.

In another refinement the at least one of the group consisting of crystals, gemstones, or metals are attached to at least one background panel.

In another refinement the background panels include a first coating. A display face of each rotating pixel in an on state includes a second coating. The second coating has a darker color than the first coating.

In another refinement at least one pixel and a first portion of the background are in a different plane than another pixel and a second portion of the background.

In another refinement the two coils are oriented in opposite directions and connected in series. The total resistance of the two coils is preferably in the range of 150 to 250 ohms.

In another embodiment of the present invention there is a watch display comprising a plurality of magnetically actuated flippers having a display face positioned within a surrounding background. The flippers rotate between a first orientation in which the display face has a first optical state, and a second orientation in which the display face has a second optical state. The watch display also includes at least one radially extending hand positioned above the flippers and the surrounding background. The hand is connected to an analog movement beneath the flippers and the surrounding background.

In one refinement there are a plurality of electromagnets. Each electromagnet corresponds to one of the plurality of magnetically actuated flippers. Each electromagnet includes a U-shaped core defined by a base portion connecting two armatures. Each armature includes a coil.

In another refinement a first group of the array of pixels are configured to display an alphanumeric character. The U-shaped cores are configured beneath the first group to minimize magnetic interference between the coils and permanent magnets of the first group of rotatable pixels.

In another refinement the display face of at least one of the flippers includes an attached material selected from the group consisting of crystal, gemstone, or metal.

In another refinement the plurality of flippers provide chronological information.

In another refinement the plurality of flippers provide time information in the form of an Arabic numeral in the first orientation and in the form of a Roman numeral in the second orientation.

In another refinement a single flipper displays AM in the first orientation and PM in the second orientation.

In another refinement a group of flippers display AM in the first orientation and PM in the second orientation.

In another refinement there are three watch hands corresponding to an hour hand, a minute hand, and a second hand.

In another embodiment of the present invention there is an electromagnetically actuated display comprising a pixel having a permanent magnet that rotates about an axis to display a first face and a second face. The first face has a first optical state, and the second face has a second optical state. The first optical state is different from the second optical state. The electromagnetically actuated display also includes an electromagnet including a U-shaped core that is oriented perpendicular to the axis of the pixel. The electromagnet includes a first coil positioned around a first arm of the U-shaped core and a second coil positioned around a second arm of the U-shaped core. Each pole of the electromagnet is positioned substantially adjacent to the permanent magnet so that current that magnetizes the electromagnet oppositely to the polarity of the permanent magnet causes a rotation of the pixel from the first face to the second face. A background that surrounds the pixel has an optical state that optically contrasts with at least one of the first face and the second face of the rotatable pixel.

In one refinement the first coil and the second coil are connected in series and have a total resistance of greater than 150 Ohms and less than or equal to 250 Ohms.

In another refinement a plurality of pixels are each associated with a corresponding electromagnet having a U-shaped core and a pair of coils. The plurality of pixels are configured to produce at least one alphanumeric character. The U-shaped cores are configured beneath the plurality of pixels in an interwoven pattern.

In another refinement the pixel rotates approximately 180 degrees between the first face and the second face.

In another refinement at least one face of at least one of the pixels has a phosphorescent painted surface.

In another refinement at least one face of at least one of the pixels has a fluorescent painted surface.

In another refinement at least one face of at least one of the pixels also includes an attached material selected from the group consisting of crystal, rhinestone, diamond, or metal.

In another refinement a bobbin is used to wrap at least one of the first coil and the second coil around the respective arm.

In another refinement a first pixel and a portion of the background adjacent the first pixel is not in the same horizontal plane as a second pixel and a portion of the background adjacent the second pixel.

In another embodiment of the present invention there is an magnetically actuated alphanumeric display. The display comprises a plurality of flippers. Each flipper includes a permanent magnet and rotates about an axis to present a display face with an on state in a first orientation and an off state in a second orientation. Each flipper is positioned substantially within a background. Portions of the background adjacent each flipper substantially match the display face in the off state. The plurality of flippers are configured to collectively present an alphanumeric character when at least some of the plurality of flippers are oriented to present the display face in the on state. The display further comprises a corresponding plurality of paired electromagnet coils in an interwoven configuration beneath the plurality of flippers.

In one refinement there is substantially no gap between a first coil corresponding to a first flipper and any adjacent coil corresponding to a different flipper.

In another refinement each of the coils has a separate interior post of ferromagnetic material.

In another refinement the alphanumeric character is an Arabic numeral formed with seven flippers.

In another refinement each of the paired electromagnetic coils in the interwoven configuration are positioned around a pair of arms of a U-shaped core. Adjacent U-shaped cores are rotated ninety degrees from one another.

In another refinement paired coils are positioned on a pair of armatures of a U-shaped core.

In another refinement each U-shaped core is oriented substantially perpendicular to the axis of the corresponding flipper, and wherein each magnetic pole of the electromagnet is positioned substantially adjacent to the permanent magnet of the corresponding flipper.

In another refinement the paired electromagnetic coils are connected in series and have a total resistance in the range of 150-250 ohms.

In another refinement the interwoven configuration includes paired coils that each have a width less than half an axial length of the corresponding flipper, and wherein an axial length of the permanent magnet of the flipper is less than or equal to half the axial length of the flipper.

In another refinement the permanent magnet of any flipper of the plurality of flippers does not overlap any coils other than the paired coils corresponding to that flipper that actuate rotation of that flipper.

In another refinement the interwoven configuration includes paired coils that overlap at least a portion of the permanent magnet of the corresponding flipper, and wherein the paired coils do not overlap the permanent magnet of any flipper other than the corresponding flipper for which the paired coils actuate rotation.

In another refinement, the display further comprises a second plurality of flippers configured to collectively present a second alphanumeric character and a second corresponding plurality of paired electromagnet coils in an interwoven configuration beneath the second plurality of flippers. The display faces of the first plurality of flippers are in a first plane. The display faces of the second plurality of flippers are in a second plane. The first plane and the second plane are different.

In another refinement the display is a watch display and further comprises an analog movement with watch hands that are positioned above the background and the plurality of flippers.

In another refinement the background includes a plurality of simulated dot matrix panels and a plurality of grooves between at least some of the adjacent panels. Each groove substantially mimics a gap between at least one of the rotatable pixels and the background In another refinement at least a portion of the display is a positive contrast display.

In another refinement the display is a watch display and is positioned within the interior of a casing. The casing has a front light LED directed toward at least a portion of the display.

In another refinement the front light is a UV LED. At least one of the flippers includes a fluorescent coating on the display face in the on state.

In another refinement a material selected from the group consisting of rhinestone, crystal, diamond or metal are attached to at least one of the background or the display face of at least one flipper.

Multiple embodiments are disclosed and claimed herein. There are numerous refinements that are generally applicable to most, if not all, of these embodiments.

In one refinement of the invention a single rotatable pixel represents more than one dot or pixel of information. For example, a single pixel might include textual information such as AM/PM/LAP/COUNTER/DATE on one or both faces.

In another refinement of the invention the rotatable pixel is round, square, rectangular, or polygonal in shape.

In another refinement of the invention the axle used is constructed out of the same material as the rotatable pixel. Alternatively, the axle might be constructed out of wire, metal or plastic rod. The axle could pass through a hole in some portion of the rotatable pixel about which the pixel rotates.

In another refinement of the invention the axle of the rotating pixel is fixed to mounting points.

In another refinement of the invention the axle is part of or affixed to the rotating pixel and rotates with the rotating pixel.

In another refinement of the invention a permanent magnet material is integrated in some portion of the rotating pixel. The permanent magnet could be a magnetic thermoplastic or rubber materials, ferrite, ceramic, Aluminum Nickel Cobalt (AlNiCo), Samarium Cobalt (SmCo), Neodymium Iron Boron (NdFeB), injection molded material, such as Nylon 6 or 12, that contains the desired mixture of magnetic material, or other magnetic materials or rare earth materials that possess a magnetic field.

In another refinement of the invention the entire pixel may be a permanent magnet material.

In another refinement of the invention the permanent magnet material is integrated in only a portion of each rotatable pixel and has magnetic poles in the same plane as the rotatable pixel.

In another refinement of the invention the permanent magnet material has magnetic poles oriented perpendicular to the plane of the rotatable pixel.

In another refinement of the invention the rotatable pixel includes a permanent magnet that has a proximity to the core or an additional pole plate and is configured to insure that the rotatable pixel does not change orientations due to vibration, or dropping (being held in place magnetically).

In another refinement of the invention the coils and corresponding rotating pixels are configured to comprise an alphanumeric character.

In another refinement of the invention the alphanumeric character is an Arabic numeral generated using seven pixels.

In another refinement of the invention an anti-reflective coating is applied to the background or OFF optical state of the rotating pixel. In a further refinement of the invention the anti-reflective finish including a light-trapping material that is applied to the background or OFF optical state of the rotating pixel.

In another refinement of the invention the rotatable pixel has at least one material affixed therein.

In another refinement of the invention the rotatable pixel may have phosphorescent or fluorescent paints on one or both sides. Additionally, fluorescent paints may be used that are colorless when UV light is absent, and that emit color when UV light is present.

In another refinement of the invention the display face of the rotatable pixel includes at least one beveled edge.

In another refinement of the invention the rotatable pixel incorporates at least one dot matrix panel that substantially matches the appearance of a surrounding background.

In another refinement of the invention the dot matrix panels have a material affixed thereto.

In another refinement of the invention the dot matrix panels are round, square, rectangular, or polygonal shaped.

In another refinement of the invention a rotatable pixel incorporates two or more dot matrix panels matching those present in the background. In a further refinement of the invention, a groove is present between the dot matrix panels on the rotatable pixel. In yet a further refinement of the invention the groove between dot matrix panels is an actual gap. Alternatively, the groove between the dot matrix panels uses paints, or coatings to mimic the appearance of an actual gap between rotatable pixels and surrounding background.

In another refinement of the invention the coils are round, square, or rectangular in shape.

In another refinement of the invention the coils are constructed out of wire, specifically copper wire, or other magnet wire, as well as conductive materials, and as such may be lines laid out on a printed circuit board.

In another refinement of the invention the core comprises two spaced apart posts (i.e. offset with no direct mechanical connection) about which the coils are wound.

In another refinement of the invention the two core posts have a larger base and the two bases are placed in close proximity to effectively function magnetically like a single U-shaped core.

In another refinement of the invention the core post or U-shaped cores are constructed out of a ferromagnetic material such as a ceramic, or steel laminates.

In another refinement of the invention the top of the core is positioned substantially parallel to the plane of the rotating pixel.

In another refinement of the invention an additional pole plate is placed above the top of the core armatures.

In another refinement of the invention the U-shaped cores are integrated into the same plane as the printed circuit board.

In another refinement of the invention the coil is produced on at least one layer of a printed circuit board. The printed circuit board could be constructed out of a flexible material. In a further refinement of the invention the respective coils are an assemblage of two or more printed circuit boards stacked or layered to stack up and produce enough turns and electromagnetic force needed to actuate the rotatable pixel.

In another refinement of the invention a plastic or other material is used to construct a bobbin that allows coils to be wound around and connect the two wires to conductive leads integrated into the bobbin. In a further refinement of the invention the bobbin is constructed out of the ferromagnetic core material and may serve as the core itself.

The various embodiments described herein are typically referred to for use in applications such as watches, clocks, other timepieces, and mobile phones. However, it should be understood that other consumer products are contemplated as within the scope of the invention.

DETAILED DESCRIPTION OF THE PREFERRED EMBODIMENTS

Figure 2:
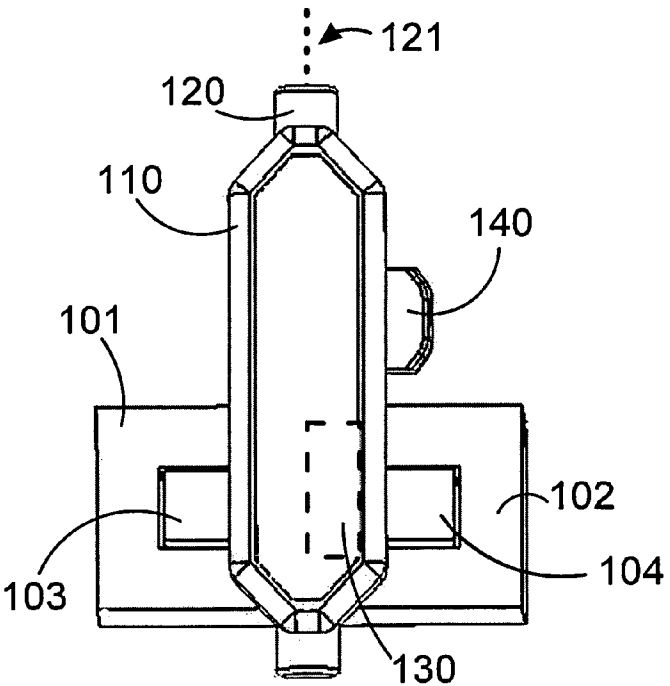
FIG. 2 is a top view of FIG. 1.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

There is an unmet need for the application of a magnetic flip dot display in consumer products where the contrasting sides of each rotatable pixel utilize one or some combination of contrasting colors, surface textures, and affixed materials. It is contemplated as within the scope of the invention that the flip dot displays disclosed herein could be used in watches, clocks, mobile phone primary or secondary display, as well as other mobile or smaller sized products.

The term flip dot display as used herein describes a rotatable pixel with at least a first display surface and a second display surface, actuated by an underlying actuation element to display one of said surfaces. Embodiments discussed herein preferably include a top face and a bottom face with 180° rotation between the two surfaces. The actuation element is preferably, for example, one or more coils of wire, or one or more coils around a core material, such as a ferromagnetic ceramic or steel laminate. It should also be understood that all of the flip dot display embodiments disclosed herein refer to a rotatable pixel changing between at least two possible optical states. When actuation force is generated (preferably magnetically) the rotatable pixel will rotate to display either an "ON" optical state or an "OFF" optical state. In the "ON" optical state the color, texture and/or material composition attached to the surface of the pixel differs from the surrounding background. An "OFF" optical state occurs when the color, texture, and/or material composition on the opposing side of the pixel substantially matches that of the surrounding background. The surrounding background is understood to refer to a non-changeable surface. The surrounding background around each rotatable pixel is preferably, but not necessarily, in approximately the same plane as the display surface of the rotatable pixel.

Figure 1:
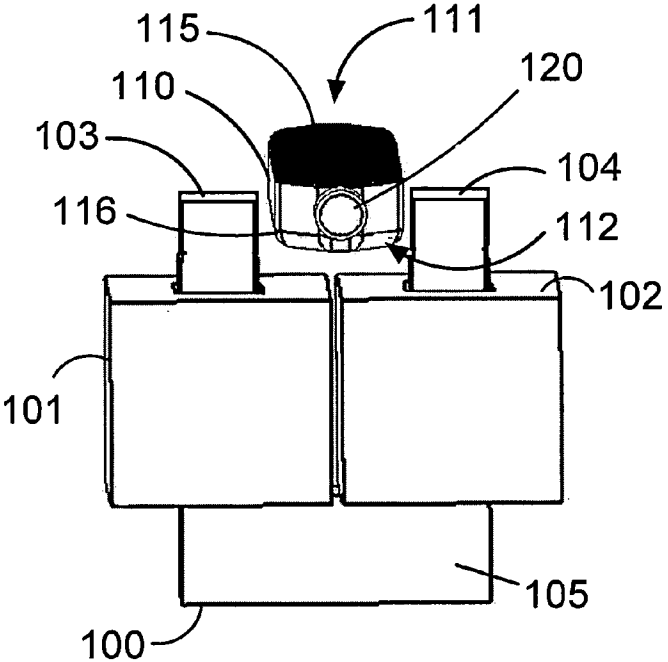
FIG. 1 is a side sectional view of one embodiment of the present invention illustrating a single magnetic actuator.

FIG. 1 features an embodiment of this invention having a single magnetic actuator. U-shaped core 100 has two armatures 103 and 104 connected by base portion 105. U-shaped core 100 could be constructed out of any ferromagnetic material, such as a ceramic or steel laminates. Two coils 101 and 102 are shown positioned around the two armatures 103 and 104, respectively. Coils 101 and 102 are typically constructed out of copper wire, but may be of any conductive wire material, or conductive deposits on a printed circuit board (PCB). Although not shown in this figure, the coils 101 and 102 may be driven individually or serially inter-connected, so they can be driven and behave as a single electromagnetic coil. Those of ordinary skill in the art recognize the various means that two coils 101 and 102 could be used to connect them electrically to behave as individual coils or as a single coil. When the coils 101 and 102 are connected serially, and current is then applied in one particular direction, it generates a magnetic force emanating out of the center of the first coil 101. The first coil 101 winding direction and orientation around the core armature 103 is such that current passing through the first coil 101 generates a positive magnetic force (a positive magnetic force being defined as a force that seeks geographical north) emanating out of the top. A negative magnetic force would be generated out of the bottom of the coil 101. The second coil 102 would be oriented so that when current is passing through the second coil 102 it produces a magnetic field in a direction that is opposite to the first coil 101. Thus, a positive magnetic force is generated out of its bottom and a negative magnetic force out of its top. The U-shaped core material effectively increases the magnetic forces generated by the current passing through either one or both coils 101 and 102.

FIG. 1 depicts a rotatable pixel 110 capable of displaying two optical states. "OFF" optical state 111 is illustrated as black in FIG. 1 on face 115. An "ON" optical state 112 is illustrated as white and is located on the bottom face 116 of the rotatable pixel 110. Rotatable pixel 110 could have a wide variety of shapes including round, square, or a rectangular shape as depicted in FIG. 1. The "OFF" and "ON" colors depicted are only representative as a wide variety of contrasting coatings, paints, or attached materials, could be used on either face. Those of ordinary skill in the art will understand how a matrix of rectangular shaped rotating pixels 110 might be used to produce a conventional alpha-numeric digit. Such combinations might find use in watch displays or other alphanumeric indicators, such as the commonly used seven pixel numeric digit, as well as fourteen and sixteen pixel alphanumeric digits. Rotatable pixel 110 turns on an axle 120 that allows it to rotate (preferably approximately 180 degrees) to display either one of the two optical states defined by the color, material, or texture present on either of two display faces.

Axle 120 is preferably a central shaft used to position the rotating pixel 110 and allow rotation. In some cases the axle 120 may be mounted and fixed, but with a bearing or bushing located inside the rotating pixel 110 to allow the pixel to rotate around the axle 120. Axle 120 could comprise a wire, or plastic or metal rod that is fixed and passes through some portion of the rotating pixel 110 that rotates around the axle 120. Rotating pixel 110 may also be constructed out of a low friction material to more easily rotate about a fixed axle 120. In FIG. 1 the axle 120 is preferably integrally formed with rotating pixel 110, and therefore has mounting points, not shown in this figure, that allow the axle 120 to rotate. The axle 120 for each pixel 110 is preferably mounted to either the underlying module or frame or surrounding background (not shown in FIG. 1). When axle 120 is not fixed, bearings, bushings, or low friction material may be incorporated into the mounting points where the axle 120 is supported. Separate bearing elements or the mounting points themselves could be made out of metal such as steel or brass, or injection molded material that may be made from or coated with some low friction material such as Teflon, or polyoxymethylene (POM). Rotatable pixel 110 has permanent magnet properties incorporated therein, and rotates when the appropriate magnetic force is generated by passing current through the underlying coils 101 and 102. The rotatable pixel 110 can be positioned above or below, but preferably has a display face approximately in the same plane with respect to the top of the two armatures 103 and 104 as shown in FIG. 1.

FIG. 2 shows a top view of an embodiment including a rotatable pixel 110 and underlying magnetic actuator with dual coils 101 and 102 around the two core armatures 103 and 104. A portion of rotatable pixel 110 has a permanent magnet 130, illustrated as a dashed rectangle indicating that that it is incorporated therein. The permanent magnet 130 could be a magnetic thermoplastic or rubber material, ferrite, ceramic, Aluminum Nickel Cobalt (AlNiCo), Samarium Cobalt (SmCo), Neodymium Iron Boron (NdFeB), injection molded material, such as Nylon 6 or 12, that contains the desired mixture of magnetic material, or other magnetic materials or rare earth materials that possess a magnetic field. Alternatively, the entire rotatable pixel 110 could be constructed out of a permanent magnet, or the permanent magnet 130 could be found in some portion thereof as depicted in FIG. 2, or multiple portions. As in the embodiment illustrated in FIG. 2, a significant portion of the permanent magnet 130 preferably lies off center, i.e., on one side of the center axle 120 that defines the axis of rotation 121.

Driving coils 101 and 102 preferably do not extend across the entire axial length of the rotating pixel 110, and even more preferably no more than half the axial length. This enables closer placement of rotating pixels 110 in some or all of the small consumer product applications detailed herein. Those of ordinary skill in the art, however, will understand that the actuation system could extend across the entire axial length of a rotatable pixel 110. FIG. 2 also illustrates a stopping mechanism 140 preferably integrated into the pixel 110. A stopping mechanism is preferably some non-symmetrical component that extends, or some portion that is removed from the rotatable pixel. Stop 140 engages the surrounding frame, background, or extension from the underlying module so as to allow nearly, or as much as, but not typically exceeding, a 180 degree rotation. Stop 140 shown in FIG. 2 is an extension of the rotatable pixel 110, versus a round or square cutout, that is commonly used in flip dot displays today. As shown in FIG. 2, stop 140 is preferably offset along the axial length from the armatures 103, 104 and coils 101, 102.

Figure 3:
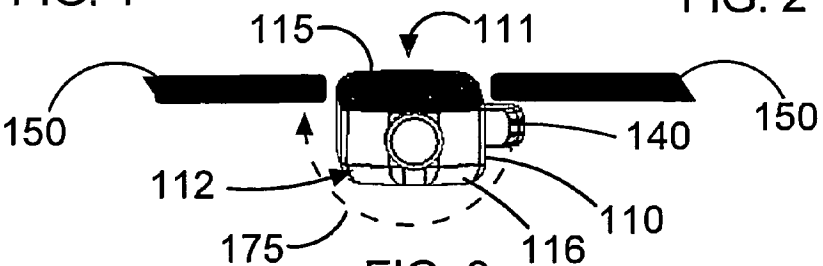
FIG. 3 is a side view of the embodiment of FIG. 1 illustrating a single rotating pixel integrated in the same plane as the surrounding background.

FIG. 3 illustrates a rotatable pixel 110 in the same plane as the surrounding background 150. Surrounding background 150 is preferably a plane of material that has portions removed in which one or more rotatable pixels 110 are positioned. Background 150 preferably has an immutable visual appearance that closely matches one of the visible states of rotating pixel 110. An "OFF" optical state 111 occurs when the visible state of the rotatable pixel 110 substantially, and ideally as closely as possible, matches that of background 150. An "ON" optical state 112 occurs when the visible state of rotatable pixel 110 differs visibly from the background 150. As illustrated in FIG. 3, the black face 115 of the rotating pixel 110 is in the visible position producing an "OFF" pixel 111 since it closely matches the black appearance of background 150. This is in contrast to the bottom face 116 which is illustrated as white and would be perceived as an "ON" pixel. The white of the "ON" state 112 significantly differs from the background 150 color, when the pixel 110 is magnetically actuated to rotate 180 degrees into this new position.

FIG. 3 also shows a cross-section of the rotatable pixel 110 as its stop 140 engages the bottom of the surrounding background 150 to limit the rotation to approximately 180 degrees. In this particular embodiment a protrusion or extension of the rotatable pixel 110 acts as the stop 140. An arc 175 illustrated as a dashed line indicates the directions of rotation possible from the current position of the rotating pixel 110. The stop 140 then engages the bottom of background 150. Using a stop 140 located beneath the surrounding background 150 provides a better design aesthetic as the rotatable pixels 110 appear symmetrical from the viewer's perspective. Those of ordinary skill can also understand how the stop 140 could also allow rotation in an opposite arc that allows it to be visible, but functions the same.

It is contemplated as within the scope of the invention that rotatable pixel 110 could also have printed text, symbols, or other information. Thus, one pixel 110 by itself conveys desired information. For example, one side of the rotating pixel 110 could have text printed on one side that says AM, and PM printed on the other side. In this scenario either face of the pixel 110 could display detailed information without having to be part of a matrix of pixels that forms an alphanumeric digit to convey information.

Figure 4:
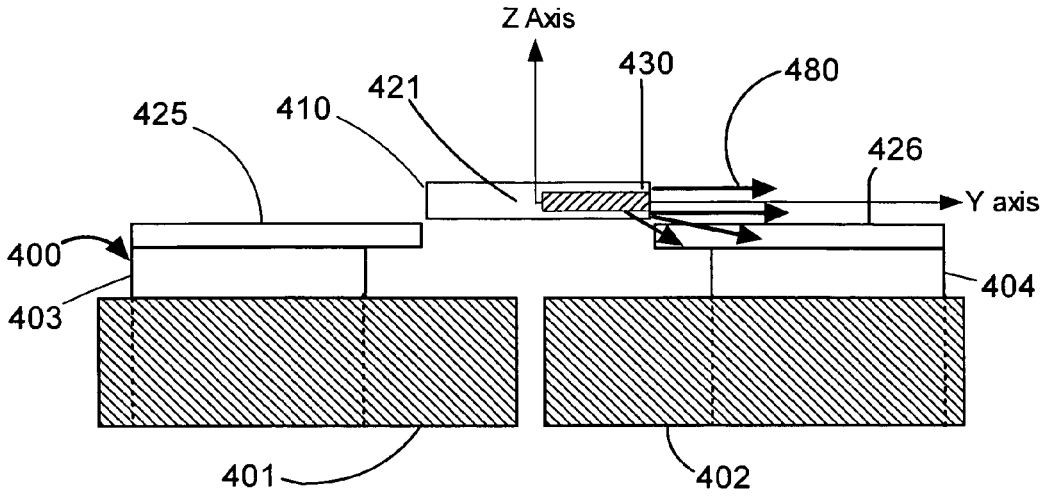
FIG. 4 is a side view of an embodiment of the present invention depicting the "OFF" state.

FIG. 4 illustrates the magnetic flux that exists within a cross section of a single actuatable rotatable pixel in "OFF" electrical state. FIG. 4 shows a magnified view of the system in an "OFF" electrical state defined as no current passing through any part of the magnetic actuation system. U-shaped core 400, of which only a portion is shown in this figure, preferably has a single driving force from two separate coils 401 and 402 located around each armature 403 and 404. Only a portion of the coils 401 and 402 are depicted, and although not shown in this figure they are preferably connected to the electronic driving circuit and driven serially, and simultaneously. The coils are also preferably arranged with opposite polarity so when driven serially with the same current they will produce magnetic field in opposite directions. A permanent magnet 430 is preferably integrated into at least a portion of rotatable pixel 410 so that at least half of the width of the permanent magnet 430 would be located on one side of the pixel axis of rotation 421. FIG. 4 illustrates an embodiment wherein the majority of the permanent magnet 430 is located to one side of the axis of rotation 421 around which pixel 410 rotates, and is magnetized so that its magnetic fields emanates parallel to its length along the Y-axis. It is also contemplated as within the scope of this invention that the permanent magnet 430 could be magnetized so that its magnetic fields would emanate perpendicular to its length, and still be functional. The resulting magnetic fields of the permanent magnet 430 would then be parallel to the Z axis shown.

FIG. 4 depicts the magnetic force lines that exist in an "OFF" electrical state with no current being driven into either or both coils 401 and 402. Armatures 403 and 404 typically provide enough attractive surface area and magnetic attraction to hold the permanent magnet 430 in place when not in the "ON" electrical state. In some embodiments, however, additional pole plates 425 and 426 may be added. In this "OFF" electrical state the permanent magnet 430 is in close proximity to a first pole plate 426 that has been placed on top of armature 404. Pole plates 425 and 426 are preferably constructed out of magnetic attractive materials such as steel, and can be used to provide a larger surface area for the permanent magnet 430 to be attracted and hold the rotating pixel in a desired orientation. Although not depicted in this figure, armatures 403 and 404 could be located directly underneath, to one side, or even parallel to the plane of the permanent magnet 430 and corresponding rotating pixel 410. Depending on the other system design components there may be certain advantages to having either the top of the armatures 403 and 404 or pole plates 425 and 426, if utilized, directly parallel to the permanent magnet 430. For example, having the top of armatures 403 and 404 or pole plates 425 and 426 in the same horizontal plane as the permanent magnet 415 and corresponding rotatable pixel 410 it resides within (or some portion thereof), may further insure that the matrix of rotating pixels all appear horizontally in line with the surrounding background In the "OFF" electrical state the strongest magnetic flux lines 480 extend out of the permanent magnet 430, the magnetic poles being oriented along the horizontal or Y-axis as shown. Permanent magnet 430 is attracted to plate 426 as well as underlying armature 404. Thus, when a display is subject to vibration, dropping, or other movement the permanent magnet 430 prevents or minimizes rotation of the pixel 410. Permanent magnet 430 is shown in FIG. 4 as being slightly above the pole plate 426 and armature 404. However, the permanent magnet 430, axis of rotation 421, and the rotating pixel itself 410 could be located in the same plane, or even below the plane of the pole plate 426 or top of the armature 404. Final material selection and overall system design must account for the maximum, vibration, drop, or other forces that the system might undergo. The resulting attractive magnetic force required being that necessary to keep the rotating pixel 410 in the desired orientation. System design must also account for the resistance of the coils 401 and 402, and the current required to drive the coils 401 and 402 to generate enough electromagnetic force to rotate the pixel 410 into a different orientation. Proper material selection and system design is particularly important in small consumer product applications such as watches, or mobile phones wherein size and battery life are concerns.

Figure 5:
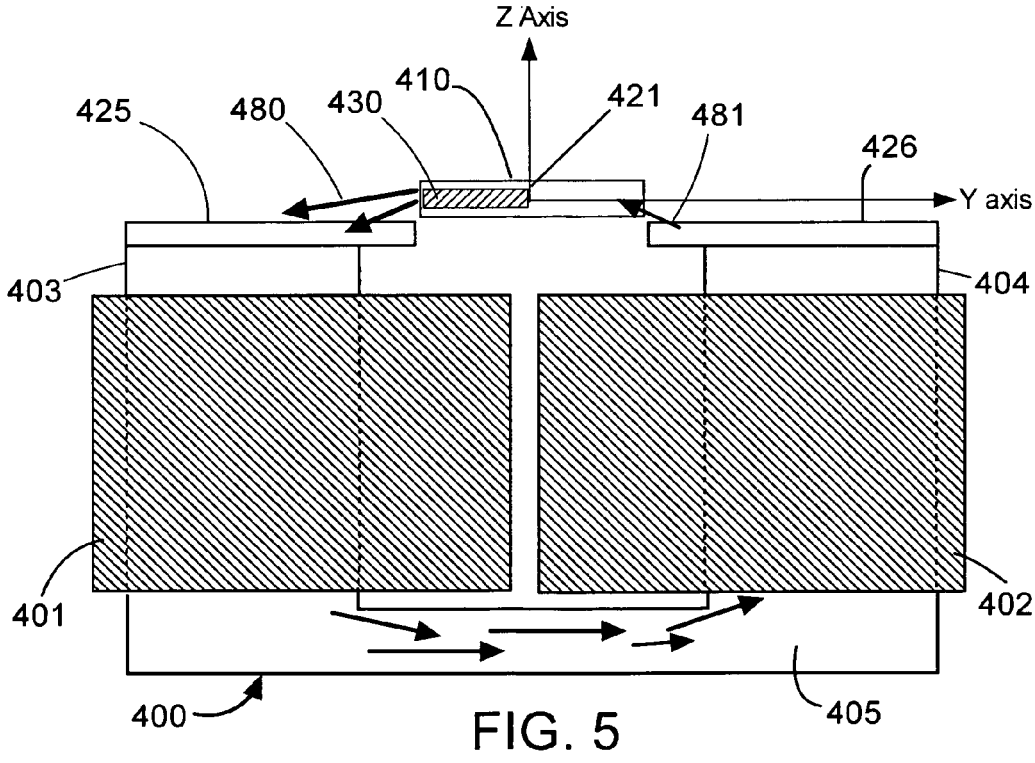
FIG. 5 is a side view of an embodiment of the present invention depicting the "ON" state.

FIG. 5 illustrates the magnetic flux that exists within a cross section of a single actuatable system in the "ON" electrical state. FIG. 5 shows a magnified view of the system in an "ON" electrical state. Current passing through the coils 401 and 402 around core 400 produces a repulsive magnetic force, with respect to the permanent magnet 430 and corresponding rotatable pixel 410. In FIG. 5 the general direction of this repulsive magnetic force 481 is out of top of coil 402, while an attractive magnetic force 480 now emanates out of the top of coil 401. FIG. 5 shows the resulting magnetic flux when "ON" current is still being applied, but the permanent magnet 430 and corresponding rotatable pixel 410 have rotated into the new, desired orientation. The current passed through the coils 401 and 402 must be sufficient to generate a repulsive magnetic force 481 that is greater than the magnetic attractive force 480 that exists between the permanent magnet 430 and either the pole plate 426 or the armature 404 in the "OFF" electrical state. This rotation of the permanent magnet 430 as part of the corresponding pixel 410 can occur in very fast response times ranging from 1 msec-50 msec. In some instances after current has been passed through the coils 401 and 402, and accelerated the permanent magnet 430 and corresponding rotatable pixel 410 toward its new orientation, but before it actually reaches the new orientation, the current could be removed. The main purpose of removing current at some point, possibly after the rotatable pixel 410 is approximately half-way between the two positions, is to reduce power consumption when there is enough momentum to insure that the rotation will be completed. FIG. 5 illustrates current still being driven in the system even though the pixel 410 is in its new optical state. One embodiment of this invention involves removing current from the system at some intermediate time during the rotation of the pixel 410 to reduce overall power consumption of the system.

Figure 6:
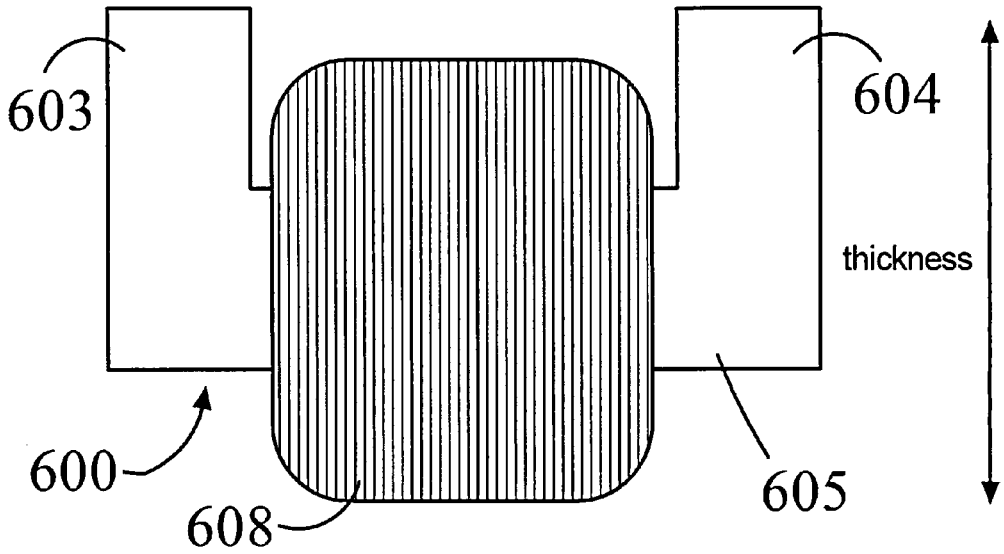
FIG. 6 is a side view illustrating aspects of a conventional flip dot electromagnet design.

FIG. 6 illustrates a conventional coil and core configuration. In this configuration the U-shaped core 600 comprises a core base 605 connecting two core armatures 603 and 604. The electromagnetic coil 608 is around the base portion 605. While contemplated as within the scope of the invention for use in some embodiments, this is not a preferred configuration. In smaller mobile devices this configuration may result in an overall thicker module due to the overall height of the core 600 and a portion of the coil 608 that then extends below the core base 605. Also, in smaller consumer devices, a larger number of coil windings (250-1000) and resulting coil resistance of greater than 75 Ohms are typically required to generate enough magnetic force using a small amount of driving current. A smaller driving current and resulting lower power consumption are important in these small, battery powered consumer product applications. The coil windings located around the core base 605 in some cases may not easily drive the smaller rotatable pixels needed. This high number of coil windings and higher resistance are not found in typical flip dot displays utilized in larger outdoor signage today.

Figure 7:
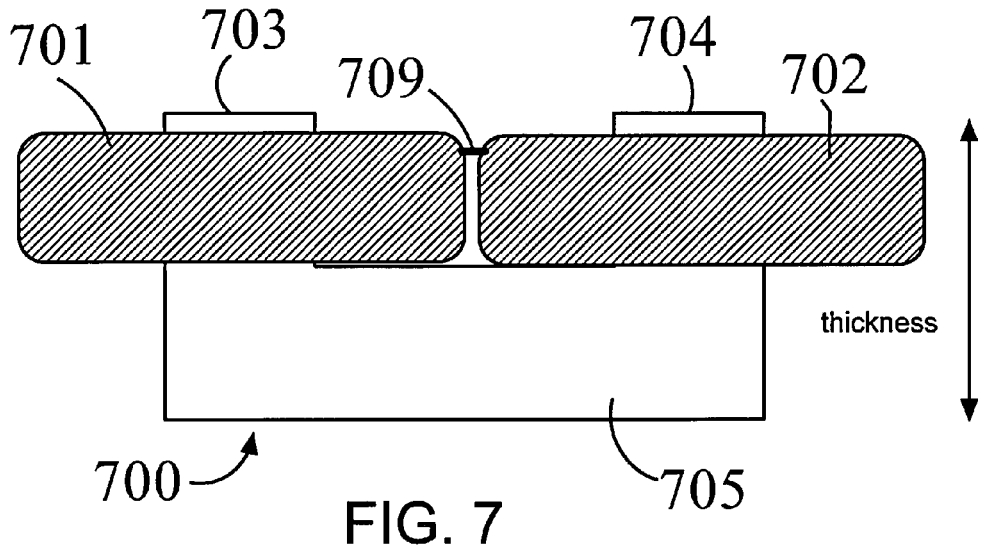
FIG. 7 is a side view of an embodiment having one coil around each armature of a U-shaped core.

FIG. 7 illustrates one embodiment of a system design optimized for reduced thickness for use in smaller displays for products such as watches, clock, other timepieces, or mobile phones. In this embodiment U-shaped core 700 has a coil 701 and 702 around core armatures 703 and 704, respectively. Armatures 703 and 704 are connected by base portion 705 of core 700. When the coils 701 and 702 are serially connected 709 they act as a single electromagnetic coil. Those of ordinary skill will recognize that there are a variety of ways to connect the coils 701 and 702 together, either directly wired in series 709 as illustrated in FIG. 7, or anywhere within the driving electronic circuitry or printed circuit board (hereinafter "PCB"). The polarity of the coils 701 and 702 are preferably oriented so that when current is passed through them they create magnetic force and flux in the same direction within the core 700, and effectively complete the magnetic circuit. One advantage of this coil configuration is that now only the thickness of the U-shaped core 700 contributes to the thickness of the overall module, while the width of the core 700 can also be minimized to drive small rotatable pixels. In one embodiment the core includes two coils in series, each coil having a resistance of greater than 75 Ohms. The total resistance of the two coils in series is preferably in the range of 150-250 ohms to preserve battery life. The coils depicted in FIG. 6 and FIG. 7 are preferably wire wound using any variety of conductive wire, such as copper. The resulting coil shape may be round, square, rectangular, etc.

Figure 8:
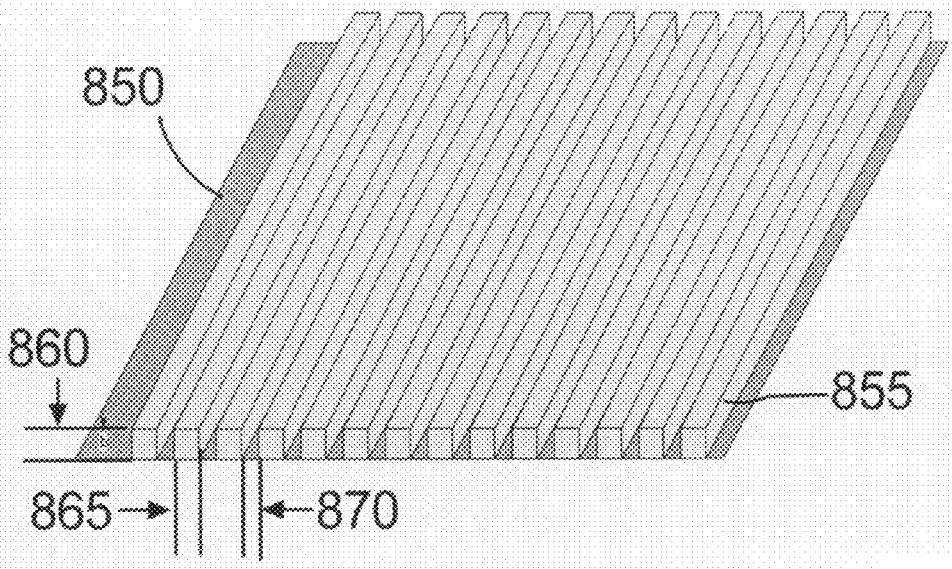
FIG. 8 is a top view illustrating parameters for producing a coil on a printed circuit board (PCB).

FIG. 8 illustrates one way that coil windings could be deposited or electro-formed on a PCB. PCB 850 upon which coil windings 855 of any variety of conductive material would be deposited or electro-formed thereon. The PCB 850 could be flexible or rigid, and the conductive material could be copper or other commonly used conductive materials. The coil windings 855 are conductive lines that vary in thickness 860, width 865, and spacing 870. Based on the available space and desired number of turns, limits of PCB manufacture, and needed magnetic force these variables can be adjusted.

Small pixels and the resulting small coils needed are often difficult to assemble and still meet low cost production targets. In a display with many coils it may prove difficult for the insertion and connection of each coil to the PCB, especially when the winding conductive wire is of a very small wire gauge. An advantage of using coils 855 constructed on a PCB 850 is that all of the coils for an entire display might preferably be constructed on the same PCB 850.

Figure 9:
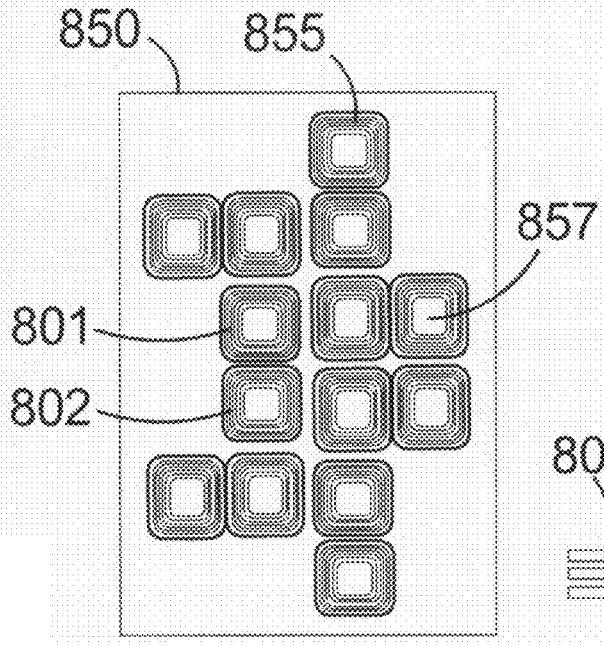
FIG. 9 is a top view illustrating one layout to produce a seven pixel numeric digit using two coils per pixel.

FIG. 9 illustrates a top view of a PCB 850 that has all the coil windings 855 needed to power seven rotatable pixels that would comprise a single numeric digit. Various rows of conductive lines are laid out in concentric circles, rectangles, or squares as shown here to form coil windings 855, preferably within a single plane. Coil windings 855 form the respective paired coils 801 and 802 that are preferably used to drive each rotatable pixel. This PCB 850 could have a hole 857 in the inner diameter of each of the coil windings 855 to allow it to fit over the corresponding core armatures 803 and 804 as taught herein.

Figure 10:
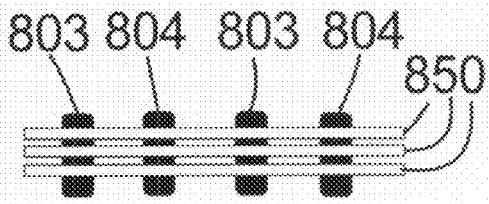
FIG. 10 is a side view illustrating multiple PCB layers connected together.

FIG. 10 shows a side view in which more than one PCB 850 layer with deposited or electroformed coil windings are interconnected. Thus, the turns of each PCB 850 layer together have the cumulative total turns required to produce the desired magnetic force when current is passed through each coil 801 and 802. The one or more interconnected PCB layers 850 include coils 801 and 802 around the corresponding core armatures 803 and 804. The core armatures 803 and 804 are inserted in the holes 857 in the PCB layers. Such a configuration provides a simpler method of assembly and connection to the respective coils when there are many coils in a module versus conventional wire wound coils.

Figure 12:
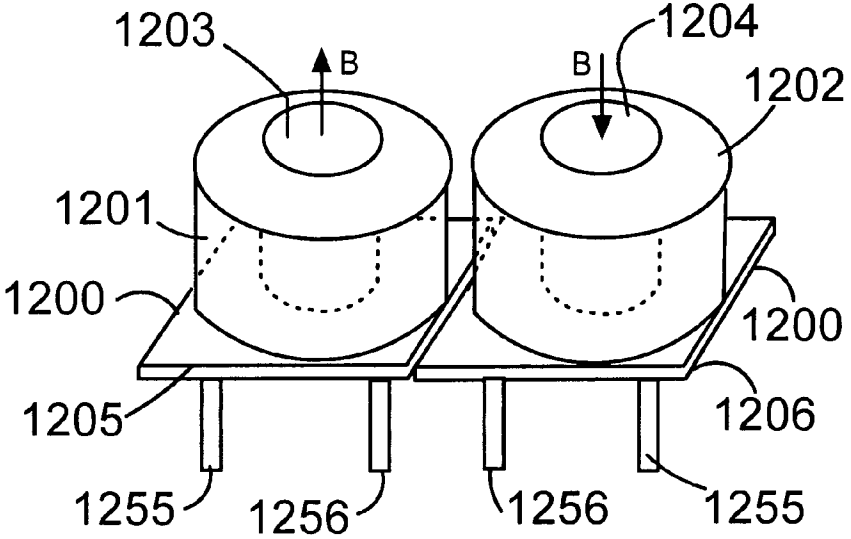
FIG. 12 illustrates another embodiment of a U-shaped core.
Figure 11:
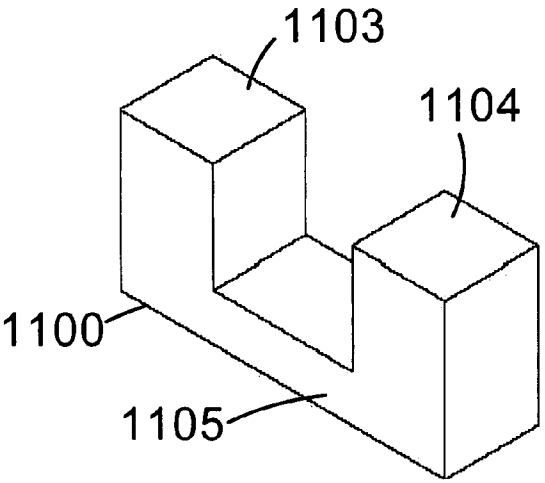
FIG. 11 illustrates one basic U-shaped core configuration.

FIG. 11 depicts a U-shaped core 1100 that includes a base portion 1105 and two armatures 1103 and 1104. The width, height, and thickness dimensions of the core 1100 are all definable based on the overall system parameters. FIG. 12 illustrates another embodiment having core 1200 broken into two parts. Armatures 1203 and 1204 act as the post about which the coils 1201 and 1202 are affixed. Armatures 1203 and 1204 can be configured wherein their core bases 1205 and 1206, respectively, are touching, or nearly touching. FIG. 12 illustrates that additional embodiments are contemplated as within the scope of the invention in which a core 1200 can be approximated in function using two separate core armatures 1203 and 1204, or posts that may be spaced apart. An advantage of this configuration is that it may be easier to assemble as well as potentially have lower cost. An additional advantage of this design configuration is the conductive leads 1255 and 1256 could be integrated into the core armatures 1203 and 1204. These conductive leads 1255 and 1256 provide a mechanism for the two leads from the coils 1201 and 1202 to be attached after being wound. In one embodiment the production of the coils 1201 and 1202 would involve the conductive wire being wound around the core armatures 1203 and 1204. In this embodiment the core armatures 1203 and 1204 act like a bobbin, which is a spindle or cylinder about which wire is wound. A complete core armature 1203 and 1204 with coils 1201 and 1202 could be inserted onto the PCB and the conductive leads 1255 and 1256 easily soldered. Those of ordinary skill in the art should recognize that the core material utilized in either FIG. 11 or FIG. 12 could be either one of many ferrite core materials including, but not limited to, ceramics or steel laminates.

Figure 13:
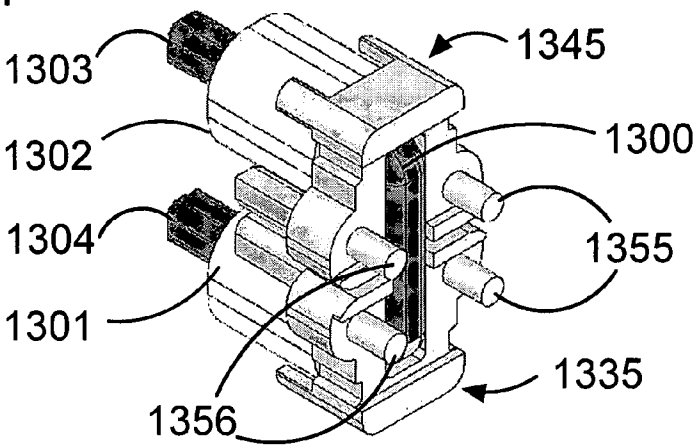
FIG. 13 illustrates an embodiment of the present invention that utilizes a bobbin integrated with the coil and core.

FIG. 13 shows another assembly solution wherein the bobbin 1335 could be constructed out of a variety of plastics. In this configuration the plastic bobbin exists as two individual assemblies 1335 and 1345 about which the coils 1301 and 1302 are first wound. The bobbins 1335 and 1345 each have two conductive leads 1355 and 1356, preferably integrated therein, about which the two conductive leads for each coil 1301 and 1302 are attached. This particular bobbin design allows for the core 1300 to then be inserted after completion of the coil windings producing a complete bobbin assembly comprising core 1300, coils 1301 and 1302 around armatures 1303 and 1304, respectively, and bobbins 1335 and 1345.

When putting a flip dot display into smaller product applications, especially those consumer products such as watches or clocks, the minimum producible size of the coils and cores required are often a large percentage of the pixel size. Thus, even producing a simple seven pixel numeric digit becomes very challenging. Those of ordinary skill in the art will recognize that in large flip dot displays the overlapping magnetic fields of pixels are minimized significantly due to distance. The situation is considerably different in smaller product applications.

Figure 14:
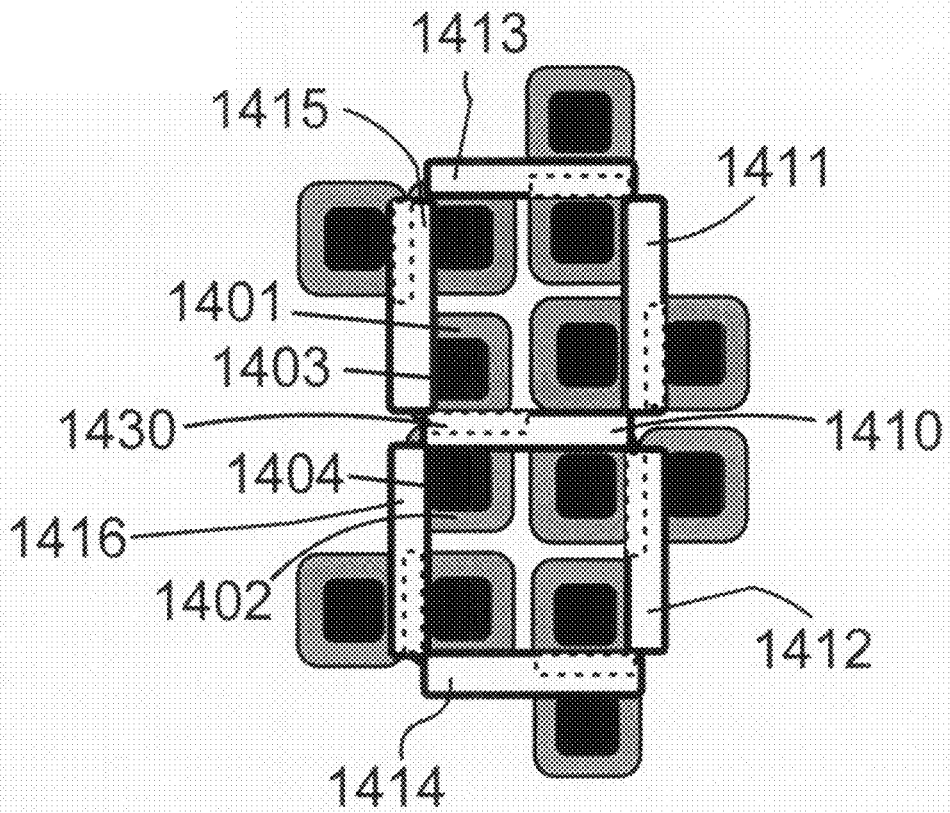
FIG. 14 is a top view illustrating a configuration of coils and permanent magnets within corresponding rotating pixels to drive alpha-numeric segments.

FIG. 14 illustrates one embodiment for constructing a standard seven segment numeric digit using flip dot rotatable pixels and seven corresponding interwoven electromagnets, each electromagnet having two coils. For convenience the seven flip dot rotatable pixels 140-1416 are each illustrated as rectangular. However, other shapes are contemplated as within the scope of the invention. Also, for convenience of illustration the surrounding background is not included in order to better understand the relationship between the underlying coils and rotatable pixels. In this particular figure the seven rotatable pixels 1410-1416 are all in the "ON" optical state so that a numeric digit number "8" is visible.

The numeric digit layout includes two coils 1401 and 1402 that are used to drive center rotating pixel 1410 positioned above the coils. The coils 1401 and 1402 are each centered around a core armature 1403 and 1404, respectively, that appears as black. A pair of coils and their respective interior core armatures are positioned to drive each of the seven rotatable pixels 1410-1416 as shown in this figure. When rotation is desired a magnetic force emanates out of the coils 1401 and 1402 when respective current is passed through them. The magnetic force acts upon the permanent magnet 1430, illustrated as a square portion (denoted by a dashed line) of the rotatable pixel 1410. The permanent magnet 1430 and corresponding rotating pixel 1410 would rotate from being positioned substantially above coil 1401 and its current "ON" optical state to a new position substantially above coil 1402 and representing an "OFF" optical state.

The coils 1401 and 1402 preferably have a width less than half the length of the corresponding rotating pixel 1410. There is no such restriction on the length or thickness of the permanent magnet 1430 incorporated in the rotating pixel 1410. The permanent magnet could be a larger portion of the rotatable pixel, or even can be the entire rotatable pixel 1410 itself. The permanent magnet 1430 preferably lies within just a portion of the length of the rotatable pixel 1410 and is ideally positioned so that it lies away from the coils driving the neighboring rotating pixels. FIG. 14 shows the seven rotatable pixels and each respective two driving coils laid out in one preferred pattern to minimize the magnetic interference between the coils and rotating permanent magnets. This is useful, if not necessary, in producing close pixel spacing desired in small consumer products. The coil orientation shown in FIG. 14 depicts just one particular coil layout for a seven pixel numeric digit, although variations thereof are considered within the scope of this invention. This same orientation could be applied to other alpha-numeric digits that may comprise more than seven pixels. It is also contemplated within the scope of this invention that the armatures 1403 and 1404 may be individual posts or part of a single U-shaped core. This design layout is one embodiment that permits the use of flip dot displays in small consumer products including, but not limited to, watches and mobile phones.

Figure 15:
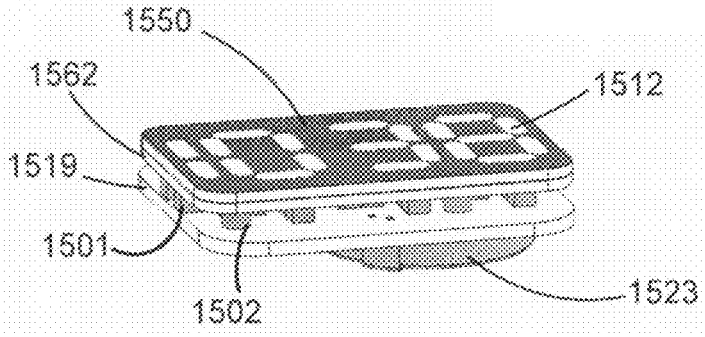
FIG. 15 illustrates a top perspective view of one embodiment of a flip dot consumer module.

FIG. 15 shows a top view of a flip dot display module in a consumer product, such as a watch. Time information is displayed by the appearance of "ON" brighter or lighter colored pixels 1512. "ON" pixels 1512 contrast with the "OFF" dark colored background 1550 and are organized to convey information in the form of conventional seven pixel numeric digits. The dark colored background 1550 and matching "OFF" optical state of the pixel is typically dark colored, and preferably black in color to better hide the spacing gap between the "OFF" pixels. In large outdoor signage application the gap between "OFF" pixels and the surrounding background is not as visible and distracting as that present in consumer products such as watches or mobile phones. Additional anti-reflective coatings, black paints or coatings, or other textures, or light trapping means are preferably used in addition to black coatings to further reduce the appearance of the spacing gap, and increase the contrast. The "ON" optical state 1512 is shown as white, but in consumer product applications there are a variety of unique paints, colors, textures, or materials that could be used. Such coatings include, but are not limited to, phosphorescent paints or coatings that would provide visible pixels even in low lighting conditions. Such coatings further include fluorescent paints (that could be further enhanced in brightness with UV front lights or LEDs), and glitter to name a few. An additional usage that could provide a unique design advantage is to use fluorescent paints that are colorless when UV light is absent, and that emit color when UV light is present. These unique clear fluorescent paints could be utilized in combination with other colors, or materials that would be utilized on the "OFF or "ON" optical states or surrounding background 1550.

The surrounding background 1550 may provide the means for holding the axle of the rotating pixels. In FIG. 15 the surrounding background 1550 is constructed using a top layer 1550 and a lower layer 1562. Lower layer 1562 could incorporate a mechanism to hold the ends of the rotatable pixel, with bearings, or injection molded structures (or hold a metal, or wire axle that would run through the rotatable pixels and allow them to rotate). Thickness is a concern with many smaller consumer product applications such as watches or mobile phones. In one embodiment a lower PCB layer 1519 preferably includes various driving electronics and a microcontroller as well as provides connections to the coils 1501 and 1502 located above it. Beneath the PCB layer 1519 is located a battery 1523 to power the electronics and flip dot display. In some applications additional plastic housing components not shown in this figure may be used to assist in the assembly and production of the display module.

Figure 16:
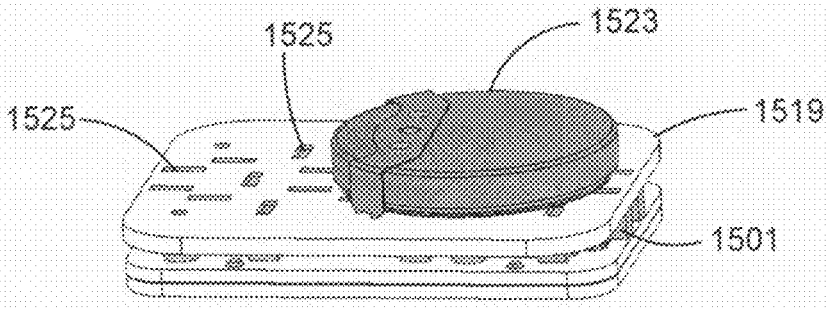
FIG. 16 illustrates a bottom perspective view of FIG. 15.

FIG. 16 depicts a bottom view of the consumer flip dot display module. Rectangular shaped holes 1525 are preferably cut within the same layer of the PCB 1519 wherein the U-shaped cores reside. This embodiment serves to further reduce the overall thickness of the display module, which is critical in these product applications.

Figure 17:
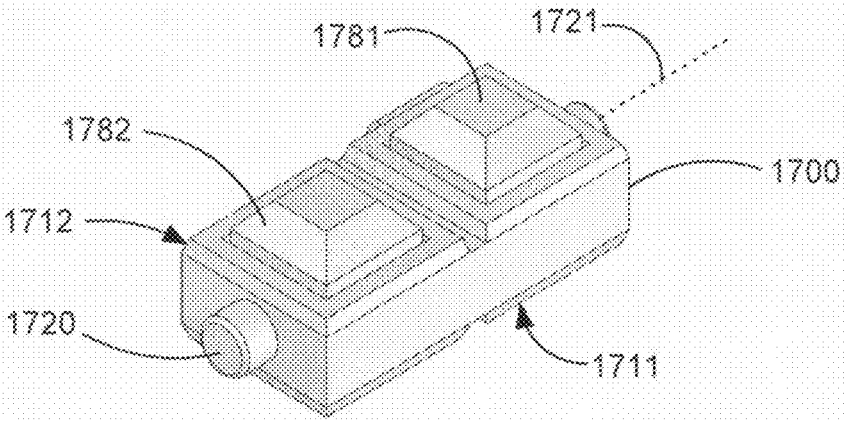
FIG. 17 illustrates one embodiment of attaching materials to the rotating pixels.

Current applications of flip dot display in large outdoor signage nearly all feature either green "ON" segments on black background, or alternatively white "ON" segments on a black background. This combination of colors have demonstrated the high contrast and readability in large outdoor flip dot displays, but these colors are less appealing to consumers in smaller consumer product applications. FIG. 17 shows another preferred embodiment that illustrates using unique materials affixed to one or both sides of the pixel 1700. FIG. 17 shows a rotatable pixel 1700 that rotates about an axle 1720 along a central axis of rotation 1721. The rotatable pixel 1700 has a bottom "OFF" optical face 1711 that would closely match the surrounding background, and an "ON" optical face 1712. Contrasting materials such as crystals, gemstones, diamonds, or metals could simply be glued or otherwise affixed in some way onto the rotatable pixel 1700. The preferred embodiment encompasses any number of different materials 1781 affixed to either or both sides of the pixel 1700 including, but not limited to crystals, gemstones, diamonds, or metals such as gold, silver, or aluminum. The rotatable pixels 1700 or surrounding background may also provide supporting means to better align the placement of the affixed materials 1781 and hold them thereon. The affixed material 1781 itself and the supporting means integrated upon the rotatable pixel 1700 can be of any shape including but not limited to round, oval, square, or rectangular. The affixed material 1781 is also preferably flat-backed, but crystals, gemstones, and diamonds may also have a non-visible surface which is pointed or shaped and must be integrated into the rotatable pixel 1700. Each rotatable pixel 1700 may contain at least one individual affixed material 1781, or two square crystals as shown in FIG. 17. For aesthetic purposes the gap distance between the rotating pixel 1700 and surrounding background is ideally minimized. To reduce the gap distance the thickness of rotatable pixel 1700 can be reduced in size, and when materials are affixed to either surface they should firstly have minimal thickness. A further embodiment has the affixed material 1781 with beveled 1782 or rounded edges as is shown in FIG. 17, which reduces the clearance needed, thereby reducing the gap spacing.

Figure 18:
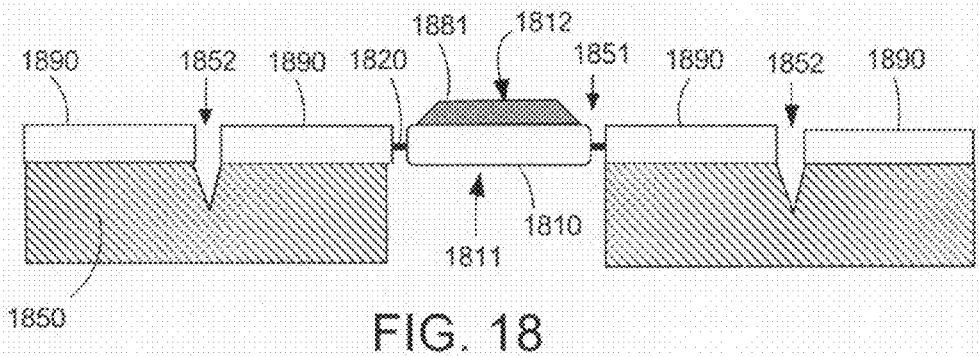
FIG. 18 illustrates a cross section of an embodiment illustrating a simulated dot matrix appearance.

Typical flip dot displays utilized in large outdoor signage applications today feature a complete large dot matrix display. This would be extremely challenging and costly for much smaller pixels, especially if organized in a dot matrix pattern in various consumer product applications. Conventional large flip dot displays also display negative contrast, with bright colored pixels on a dark background. However, readability or desirable aesthetic appearance might often preferably include a positive contrast display. FIG. 18 illustrates one embodiment of a simulated dot matrix flip dot display. In FIG. 18 surrounding background 1850 is broken into simulated dot matrix panel 1890. Panels 1890 appear to the viewer to be individual addressable pixels, but in fact are fixed and do not change.

FIG. 18 illustrates rotatable pixel 1810 that rotates approximately 180 degrees. Pixel 1810 rotates about an axle 1820 that is preferably mounted in some fashion to either the surrounding background 1850 or underlying module. Rotatable pixel 1810 preferably includes a paint, coating, or material affixed to one face 1811 that substantially matches the surrounding background simulated dot matrix elements 1890.

The simulated dot matrix panels 1890 appear as a uniform repeating pattern across the flip dot display. Thus, display face 1811 corresponds to the "OFF" optical state when oriented to be visible. The other face 1812 of the rotatable pixel 1810 has a coating, paint, or affixed material 1881 that differs from surrounding background simulated dot matrix panels 1890. Display face 1812 corresponds to the "ON" optical state. Rotatable pixel 1810 might feature at least one dot matrix panel 1890 upon one or both display faces, but it is not limited to displaying a single dot matrix panel 1890. In FIG. 18 the affixed material 1881 on the rotatable pixel 1810 is designed to have the same shape, and dimensions as a dot matrix panel 1890 found on the surrounding background 1850. The viewer will see what appears to be a complete dot matrix display, however, some portion (preferably the majority) of the display area will be non-addressable simulated dot matrix panels 1890. This preferred embodiment allows one to produce what appears to be a dot matrix display in a consumer product application, when it might not otherwise be possible to produce a dot matrix flip dot display due to size or cost constraints.

Rotatable pixel 1810 preferably rotates up to 180 degrees and is separated from the surrounding background 1850 by a gap 1851. Any separation gap 1851 between materials results in a dark outline around every rotatable pixel 1810 visible to any consumer looking at a conventional flip dot display. One method to reduce this undesired aesthetic effect is to simply color the background dark colored or black. However, various embodiments of the present invention might also use a groove 1852 in the form of an actual spacing or cutout portion, or simply a dark line placed between the simulated dot matrix panels 1890 of the background 1850. In a preferred embodiment groove 1852 has a width, thickness, and appearance to mimic or closely approximate the appearance of the actual gap spacing 1851 between rotatable pixels 1810 and the surrounding background 1850. In one embodiment the result is a repeatable dark outline around all the simulated dot matrix panels 1890 of the entire display. Consequently, the dark outline around the rotatable pixels 1851 no longer stands out. By elimination of the perceived gap 1851, this embodiment permits varying bright or dark colors or materials to be used on the simulated dot matrix panels 1890 and rotatable pixels 1810, while maintaining an acceptable aesthetic appearance. When brightly colored paints or materials are used on the simulated dot matrix panels 1890, there will exist a dark border around them. It is contemplated as within the scope of the invention that the simulated dot matrix panel 1890 could be round, square, or any other polygonal shapes that interlock in a dot matrix pattern. FIG. 18 depicts the simulated dot matrix panel 1890 as just having a colored, or painted appearance, but it could also have materials affixed.

Figure 19:
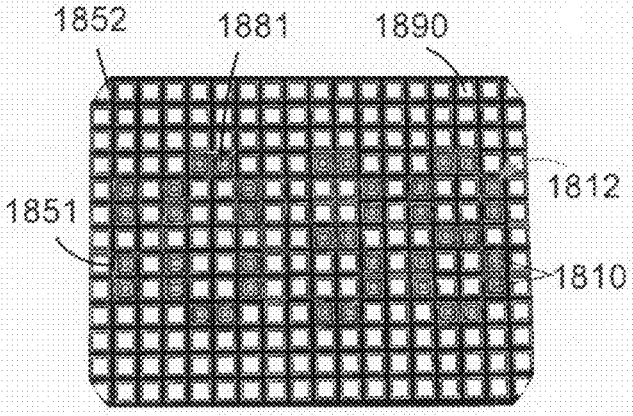
FIG. 19 illustrates a top view depicting a simulated dot matrix display with a positive display image.

FIG. 19 shows a top view of one preferred embodiment of the complete simulated dot matrix display. FIG. 19 illustrates a simulated dot matrix display for use in a clock or watch application using the standard three and half numeric digits to display time. The overall simulated dot matrix appearance is produced by having a deliberate groove 1852 (black coloring or a cutout portion), between the individual dot matrix panels 1890. Groove 1852 better hides the appearance of the actual gap spacing 1851 that exists around each rotatable pixel 1810 as a viewer is unable to easily distinguish between them. The numeric time information is produced by the contrast from individual affixed darker materials 1881 (whether paint or crystals or gemstones) on a white dot matrix panel 1890 background. It is considered a simulated dot matrix display since each dot matrix panel 1890 appears to be an addressable individual pixel, but in fact there are a far lesser number of active rotatable pixels 1810. In FIG. 19 each rotatable pixel 1810 actually comprises two affixed materials 1881 effectively appearing as two darker colored versions of corresponding dot matrix panels 1890. This embodiment produces a consumer acceptable dot matrix display appearance, yet in this example only utilizes 3 and ½ numeric digits, with seven rotatable pixels 1810 defining each numeric digit. Therefore a working display using only 23 rotatable pixels 1810 appears to a viewer as a dot matrix display with 18 columns by 13 rows of addressable pixels. The final result in this particular example is a white colored simulated dot matrix 1890 contrasted by the "ON" optical state of display face 1812 of the rotatable pixel 1810 that features dark colored crystals or affixed material 1881 thereon. The ability to produce a positive contrast display image with no distraction of the dark colored gap 1851 around each rotatable pixel 1810 is one potential application of the simulated dot matrix. The grooves 1852 effectively minimize the appearance of the real spacing gap 1851 between rotatable pixels 1810 and the surrounding background 1850.

Figure 20:
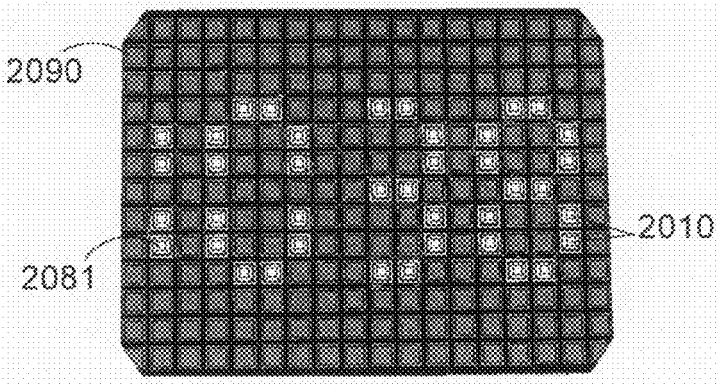
FIG. 20 illustrates a top view depicting a simulated dot matrix display with a negative display image.

FIG. 20 displays a simulated dot matrix layout in a negative display contrast. In this embodiment brightly colored paints, coatings, or materials 2081 affixed to the rotatable pixels that includes two dot matrix panels 2010 produce an "ON" appearance in contrast with dark, or black colored dot matrix panels 2090.

Figure 21A:
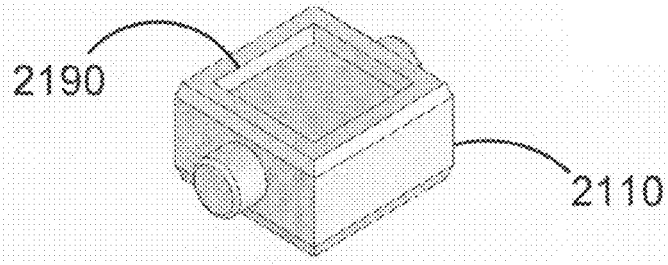
FIG. 21*a-c* illustrate top views of embodiments of a single rotatable pixel that would appear to a viewer to include one, two, or four dot matrix panels.
Figure 21B:
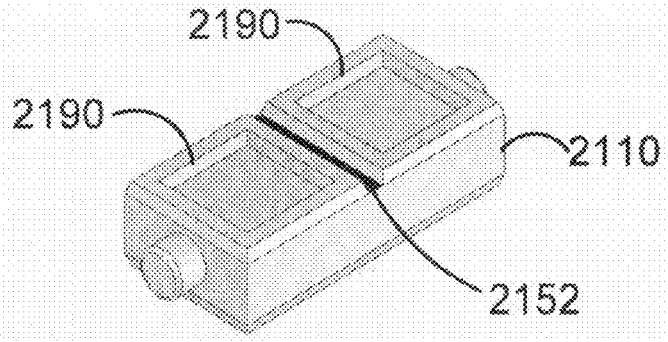
Figure 21C:
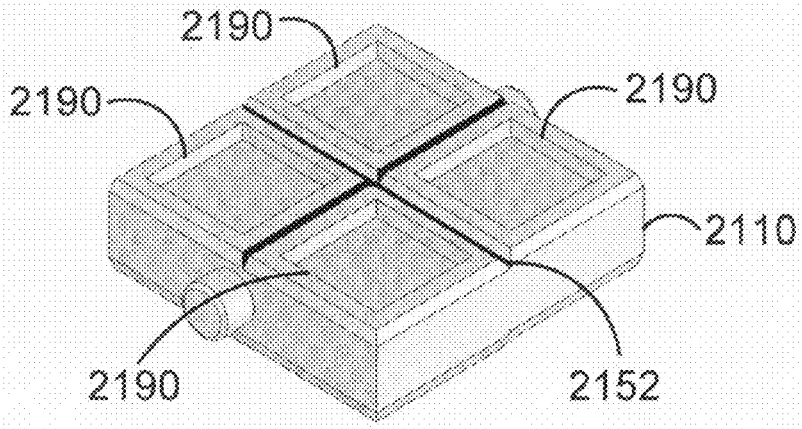

FIG. 21*a-c* further illustrates a magnified view of different versions of rotating pixel 2110 that features one or more individual dot matrix panels 2190 that are perceived as individual pixels. FIG. 21*a* illustrates the most basic concept where the rotatable pixel 2110 features just one corresponding dot matrix panel 2190. The dot matrix panel 2190 as shown in this figure could then feature simply paints, colors or coatings, or materials affixed onto either or both sides of the rotatable pixel 2110. FIG. 21*b* illustrates a rotatable pixel 2110 where there are two dot matrix panels 2190 and a groove 2152 is placed between the panels. The groove 2152 preferably substantially matches the appearance of the actual gap that occurs between the rotating pixel 2110 and surrounding background (not illustrated in FIG. 21). The rotatable pixel 2110 illustrated in FIG. 21*b* represents the configuration utilized in the displays shown in FIG. 19 and FIG. 20. FIG. 21*c* shows an additional configuration where four dot matrix panels 2190 have been integrated onto one rotatable pixel 2110. FIG. 21*a-c* illustrate embodiments wherein a rotatable pixel 2110 utilized in a simulated dot matrix display contains at least one dot matrix panel 2190, or may contain two or more panels.

In FIG. 18-21 the simulated dot matrix panels that appear on the background or either or both sides of the rotatable pixel are not limited to round dots, but could be square, rectangular, or any other shape. It is understood to be within the scope of the invention that the simulated dot elements found on the background or rotatable pixels might include: a color coating or paint, or be affixed materials such as diamonds, gemstones, crystals, rhinestones, and metals such as brushed or polished aluminum, gold, silver, etc.

Figure 22:
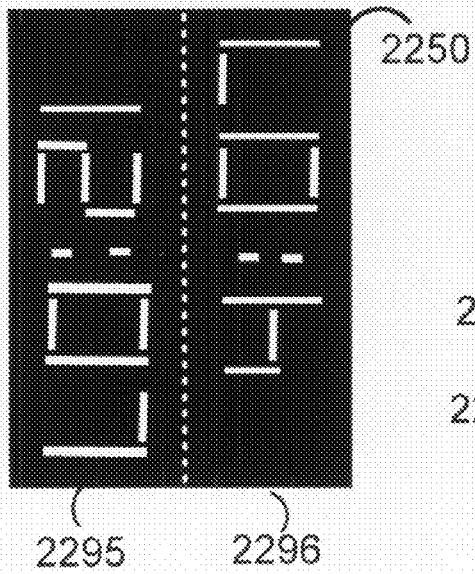
FIG. 22 illustrates a top view of another embodiment featuring a non-planar flip dot display.
Figure 23:
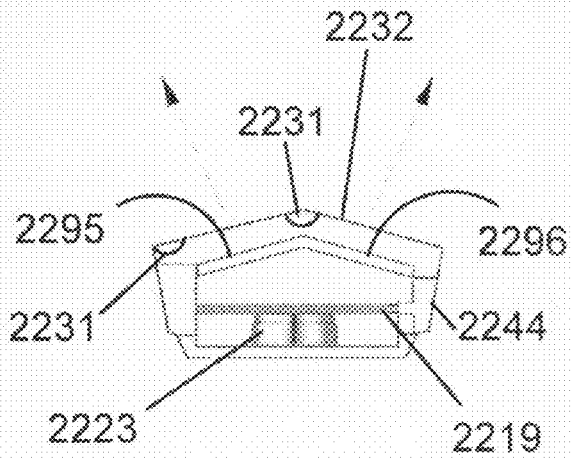
FIG. 23 illustrates a cross-section of a watch case with supporting electronics and components driving a non-planar flip dot display.
Figure 24:
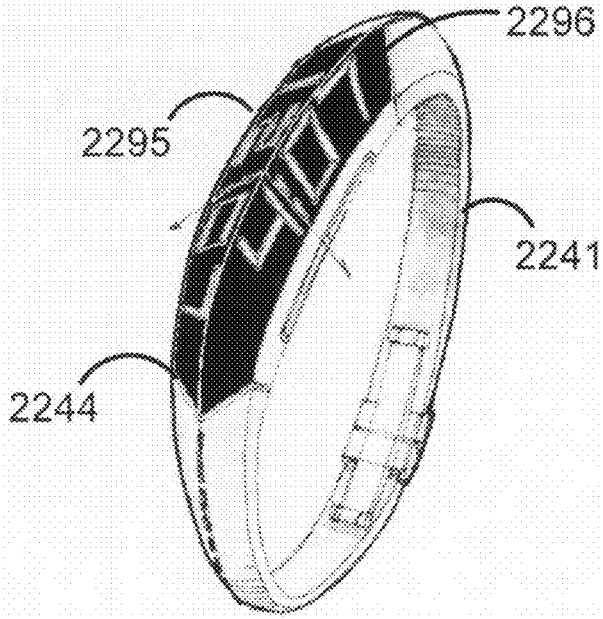
FIG. 24 is a perspective view of a watch having a non-planar flip dot display.

FIGS. 22-24 illustrate an embodiment of a flip dot display integrated into a product such as a watch wherein the display includes at least one pixel not in the same horizontal plane as the other rotatable pixels.

FIG. 22 illustrates a top view of a stylized flip dot display dial featuring "ON" brightly colored pixels on a black background 2250 depicting time information that you may find in a watch. An advantage of the flip dot display technology taught herein is that a watch utilizing this technology could now provide time information in a high contrast, bi-stable, and varying colored or varying material information display. A timing circuit on the PCB within the watch case determines time, date, and other information. The circuitry within the watch would also drive current through the respective coils to rotate the appropriate pixels into an "ON" optical state contrasting with the background 2250. FIG. 22 illustrates an example of a bisected display. The rotatable pixels and surrounding background 2250 lying to the left side 2295 of the display are not in the same horizontal plane as those rotatable pixels and surrounding background 2250 found on the right side 2296 of the display. Moreover, the backgrounds might be different colors. Additionally, the left side might be a positive contrast display and the right side a negative contrast display.

FIG. 23 shows a cross section of a watch case 2244 incorporating both portions of the angled and bisected flip dot display 2295 and 2296 illustrated in FIG. 22. The bisected flip dot display 2295 and 2296 are driven as one display but are configured so that some flip dot pixels do not lie in the same horizontal plane as others for aesthetic and design appeal. FIG. 23 also depicts front light LEDs 2231 that could be placed on the edges of the case or even inside crystal 2232. LEDs 2231 emit light onto the face of the flip dot display 2295 and 2296 when activated. The front light LEDs 2231 might be of any visible color, or even emit UV light to activate fluorescent paints present in the flip dot display 2295 and 2296. Fluorescent paints could also be used that are colorless in normal light, but change color or become visible in the presence of UV light. The bisected flip dot display 2295 and 2296 are connected to the underlying printed circuit board 2219 containing microprocessor timing circuit, display drivers, and a battery 2223 within the watch case 2244. The watch case 2244 contains the timing circuit, display driver, integrated on the PCB 2219, bisected flip dot display 2295 and 2296, and underlying battery 2223. Watch case 2244 is preferably water tight. The resulting flip dot display image produced and visible to the consumer is a unique angled digital watch display. FIG. 24 illustrates how such a watch 2241 would appear featuring a flip dot display 2295 and 2296 in which all of the pixels do not lie in the same horizontal display plane. FIGS. 22-24 illustrate one embodiment of this invention featuring a flip dot display within a watch, as well as the more unique application wherein the flip dot displays include pixels not in the same horizontal plane. Those of ordinary skill will understand how the watch example illustrated is not limiting, and the feature of a flip dot display that is not completely flat and horizontal could be integrated into any other consumer products.

Figure 25:
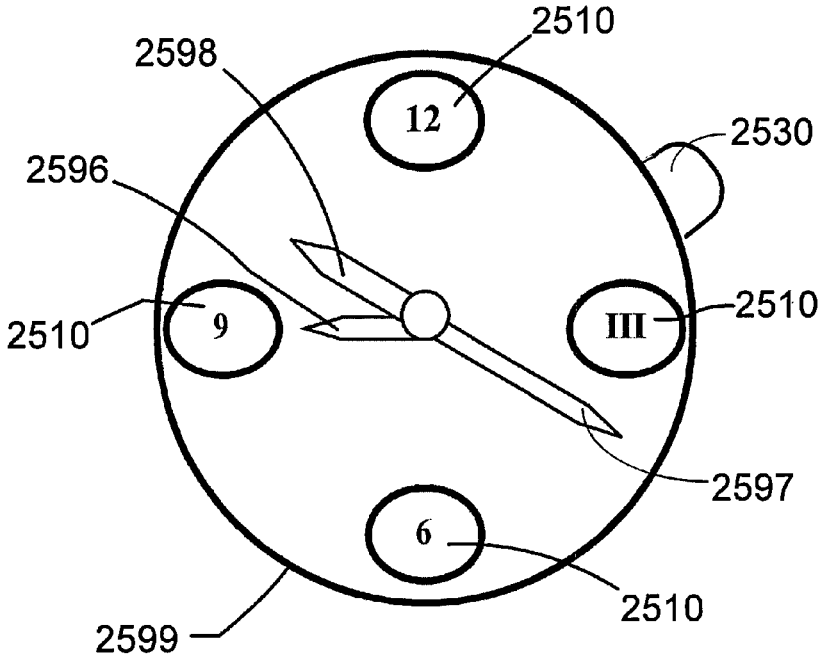
FIG. 25 illustrates one embodiment of a timepiece combining an analog watch dial with a flip dot display.

FIG. 25 illustrates an embodiment that utilizes one variation of a flip dot display herein in a watch, clock or other form of timepiece. Dial 2599 utilizes a typical three-hand analog timepiece movement defined by the hour hand 2596, minute hand 2597, and seconds hand 2598 used to indicate time. At least one rotatable pixel 2510 is preferably incorporated into the dial 2599. In this particular design the rotatable pixels 2510 are placed at the time indices at three, six, nine and twelve o'clock. The rotatable pixels 2510 in this design feature two different orientations. The first optical state features an Arabic numeral number such as 3, 6, 9 or 12. The second optical state has Roman numeral indicators III, VI, IX and XII on the opposite side. One or both optical states of the rotatable pixel 2510 could also be purely aesthetic, graphical instead of providing information. For example the rotatable pixel 2510 could change state from one colored gem to another colored gem providing simply a unique design or aesthetic appearance. Various automatic electronically or manually controlled means can be employed as to when the pixel 2510 changes from one visible state to another. In one embodiment, as the seconds hand 2598 rotates and passes over rotatable pixels 2510 at selected indices they would change from an Arabic numeral to a Roman numeral (or vice-versa). Additionally, button 2530 could be used to allow the user to manually activate a change of one or more of the rotatable segments 2510. The rotatable pixels 2510 could also be arranged in a matrix form to provide supplemental numeric information such as time, chronograph, or date information to support time represented by the analog dial. Also, an additional rotatable pixel (not illustrated) with printed text thereon which rotated between "AM" and "PM", or between "Time" and "Chrono" could be used.

Figure 26:
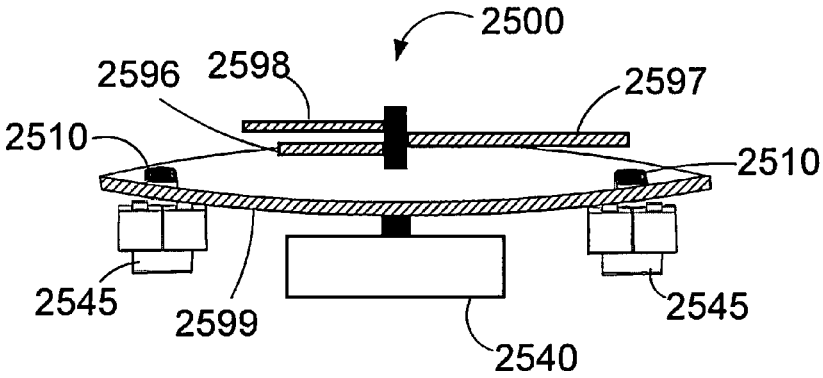
FIG. 26 is a cross section of a timepiece that utilizes an analog watch dial in combination with at least one rotatable pixel.

FIG. 26 shows a cross-section of a timepiece 2500 that utilizes at least one rotatable pixel 2510 therein. Beneath the timepiece dial 2599 is an analog movement 2540 that connects to the hour hand 2596, minute hand 2597, and seconds hand 2598. Conventional analog watch movements feature very small distances between the top of the analog movement 2540 and the bottom of the nearest hand, typically the hour hand 2596 designed for small timepiece dial 2599 thicknesses. When the rotatable pixel 2510 is actuated and rotates to display another optical state it will extend outside the plane of the surrounding timepiece dial 2599 and might contact the rotating hour hand 2596, minute hand 2597, or second hand 2598. An analog movement 2540 featuring higher than typical hand height(s) could be used in these instances. Beneath the time dial 2599, and specifically underneath each of the rotatable pixels 2510, is a magnetic actuator 2545. The magnetic actuator 2545 could be any one of the different variants of flip dot displays disclosed herein, but is most preferably a U-shaped core with a coil around each armature. Those of ordinary skill in the art will recognize how other types of analog movements could be used and are contemplated as within the scope of the invention including multi-function and chronometer analog timepieces.

Figure 27:
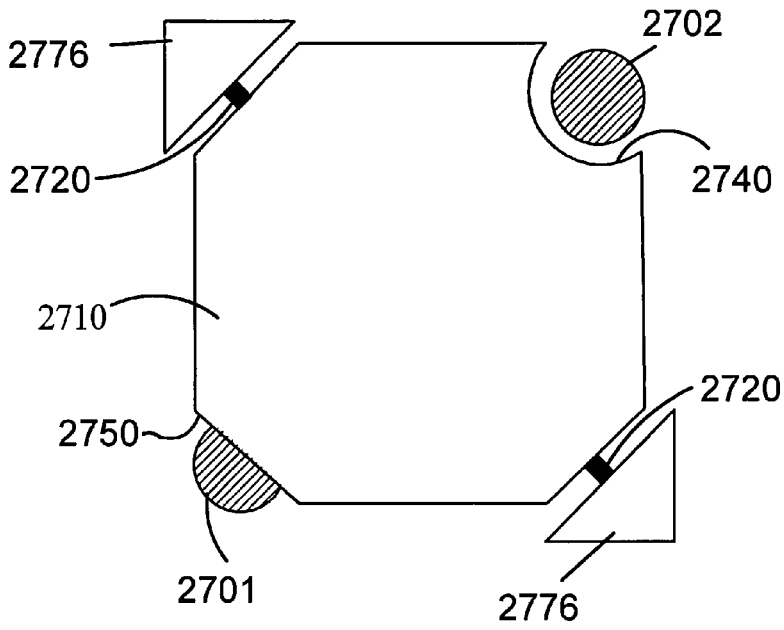
FIG. 27 illustrates a top view of another rotatable pixel configuration.

FIG. 27 illustrates another embodiment including a configuration with a different stop 2750. Rotatable pixel 2710 can rotate up to 180 degrees about an axle 2720. The axle 2720 is mounted to supports 2776. The support 2776 may be visible as part of the background or it may be part of the underlying module. The rotatable pixel 2710 is actuated magnetically by two underlying coils 2701 and 2702. The coils 2701 and 2702 may also be affixed in some fashion to two separate ferromagnetic posts. This configuration includes a cutout 2740. The rotating pixel 2710 rotates 180 degrees and the cutout 2740 allows rotation without hitting either coil 2701 or 2702. The opposite side of the rotating pixel 2710 includes stop 2750 that engages the top of coil 2701. The viewer will see the visible cutout 2740, which although functional may not always provide the desired consumer aesthetic appeal. It is understood that the rotatable pixel 2710 design, corresponding stop 2750, and driving coil 2701 and 2702 post design featured in FIG. 27 is applicable to other embodiments described herein. It should further be understood that coils 2701 and 2702 are preferably, but not necessarily, mounted on armatures of a U-shaped core. That is to say, it is understood that in some embodiments the coils 2701 and 2702, unless explicitly claimed otherwise, may instead be mounted on separate posts.

All of the embodiments of this invention detailed herein feature rotating pixels often arranged in an array that individually and/or collectively display information in the form of symbols, or alphanumeric characters, but are not limited to these representations. The rotatable pixel found in any one of the embodiments of this invention could be of a round, elliptical, square, rectangular, triangular, or any other polygonal shape. All various shapes of the rotatable pixels are assumed to be utilized especially as differing shapes may be utilized within the array itself so as to be able to impart the desired symbolic, graphical, or alpha-numeric representations collectively. The materials that might be attached to one or more faces of each rotatable pixel include, but are not limited to, emeralds, rubies, opals, amethyst, diamonds, or other gems. Other materials that might be used include, but are not limited to, gold, silver, aluminum, rhinestones, Swarovski crystals, fluorescent or phosphorescent paint glitter, cloth or leather, tritium tubes, hot metal laminates, glass spheres, and plastic laminates that provide a metal, leather, or wood grain appearance. In yet another preferred embodiment the overall thickness of the rotatable pixel is minimized so that the needed gap between the rotatable pixels and surrounding background is minimized. The pixel may also feature beveled or rounded corners to further reduce the gap between the pixels and surrounding background by requiring less clearance distance.

All of the coils illustrated in the figures show a relatively round or elliptical shape. It will be recognized that the final shape, number of turns of coil, thickness of wire or type of wire used in producing the coils, are all able to be customized and varied to produce the desired magnetic field force as well as shape of the produced magnetic field. Any and all possible variations for the shape, location of first permanent magnet, and design of the rotatable segments as well as the underlying actuation coils are contemplated as within the scope of the present invention.

In existing large sized commercial applications of utilizing flip dot displays, only bright and dark colored segment elements and frame are used, where the bright segments are usually a fluorescent green, yellow, or white. This in itself does provide the highest degree of visibility of display information to a user, but in the embodiments taught herein, one preferred objective is to use this new flip dot display technology in consumer products. Such products could include watches, mobile phones, clocks, or MP3 players. In all these consumer products design and style are of ever increasing importance. However, until now, there has been little unique design or styling that could be done with the basic black-on-grey LCD often used in these products.

The present invention also contemplates the use of differing materials, or materials of the same composition but differing in color, texture, or some other optical qualities in the "on" and "off" surface orientations, as well as the surrounding upper surface of the background. For example, the materials that could be used on the display faces and upper surface of the background include, but are not limited to, those previously discussed above. Thus, various embodiments of the present invention broadly teach the use of several variants of flip dot display technologies. Rather than simply having a light and dark colored plastics, various materials are preferably incorporated into one or both display faces of the rotatable pixel, as well as onto the upper surface of the surrounding background. Various mechanisms can be utilized to attach the indicated materials to the desired surfaces including, but not limited to, glue or epoxy, heat fusing, adhesive, or ultrasonic bonding, to name a few.

As used herein the term U-shaped broadly encompasses U-shaped, C-shaped and other embodiments generally having a base portion that connects two arms. The connection between each arm and the base portion may be perpendicular or may be curved. Moreover, the base portion itself is not necessarily straight and may be curved if desired.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A watch comprising:

an array of rotatable pixels that provide chronological information, at least a portion of each rotatable pixel including a permanent magnet, wherein each pixel rotates between a first orientation to present a first display face with a first optical state and a second orientation to present a second display face having a second optical state, the first optical state being different from the second optical state, and wherein at least some of the pixels are adjacent to a background that substantially matches one of the first optical state and the second optical state;

means for magnetically rotating the array of rotatable pixels; and a battery electrically connected to the means for magnetically rotating.

2. The watch of claim 1, wherein the means for magnetically rotating the array of rotatable pixels comprises a plurality of electromagnets, each electromagnet, having a U-shaped core defined by a base portion connecting a first arm and a second arm, and wherein the first arm includes a first coil and the second arm includes a second coil.

3. The watch of claim 2, wherein the U-shaped cores are integrated into the same plane as a printed circuit board.

4. The watch of claim 2, wherein the resistance of each coil is greater than 75 Ohms.

5. The watch of claim 2, wherein a bobbin is used to wrap at least one of the first coil and the second coil around a respective arm of a U-shaped core.

6. The watch of claim 1, wherein the background includes a plurality of simulated dot matrix panels and grooves between at least some of the panels that are adjacent to each other, and wherein each groove substantially mimics a gap between at least one of the rotatable pixels and the background.

7. The watch of claim 6, wherein the display is a positive contrast display and an on optical state of at least one rotatable pixel is darker than the surrounding panels of the background.

8. The watch of claim 6, wherein each groove is a dark line.

9. The watch of claim 1, wherein at least one of the display faces of at least one of the array of rotatable pixels includes an attached material selected from the group comprising rhinestone, crystal, or diamond.

10. The watch of claim 1 further comprising an analog movement with watch hands that are positioned above the background and the array of pixels.

11. The watch of claim 1, wherein a first group of pixels in the array of pixels are in a first plane, and wherein a second group of pixels in the array of pixels are in a second plane, the first plane and the second plane being different.

12. The watch of claim 1, wherein at least one of the first display face and the second display face of at least one pixel includes a coating consisting of a phosphorescent coating or a fluorescent coating.

13. The watch of claim 1, wherein a first group of the array of pixels are configured to display an alphanumeric character, and wherein the means for magnetically rotating the array of rotatable pixels controls rotation of the first group, each rotatable pixel of the first group being, rotated by a U-shaped core having two arms that each have at least one cod, the U-shaped cores being positioned beneath the first group in an interwoven configuration.

14. The watch of claim 1, wherein the first display face or the second display face of at least one of the rotatable pixels includes at least one beveled edge.

15. The watch of claim 1, wherein each rotatable pixel includes a stop protruding from a side of the rotatable pixel, and wherein the stop is substantially hidden beneath the background.

16. The watch of claim 15, wherein the rotatable pixel rotates approximately 180 degrees.

17. The watch of claim 1, wherein at least one rotatable pixel by itself includes textual information on one or both display faces.

18. The watch of claim 17, wherein a single rotatable pixel displays AM on the first display face and PM on the second display face.

19. A watch display, comprising:

a plurality of magnetically actuated rotatable pixels positioned within a background that includes a plurality of simulated dot matrix panels and a plurality of grooves between at least some of the adjacent panels, wherein each groove substantially mimics a gap between at least one of the rotatable pixels and the background, wherein each pixel rotates between a first orientation with an off optical state that substantially matches the panels around that pixel and a second orientation with an on optical state that differs from the panels around that pixel, and wherein at least one rotatable pixel in the off optical state includes a plurality of panes, each pane being substantially the same size as the simulated dot matrix panels.

20. The watch display of claim 19, wherein at least a portion of the display is a positive contrast display and an on optical state of at least one rotatable pixel is darker than the surrounding panels of the background.

21. The watch display of claim 19, further comprising means for magnetically rotating the plurality of rotatable pixels, wherein at least a portion of each pixel includes a permanent magnet, and wherein the means for magnetically rotating includes a plurality of electromagnets, each electromagnet corresponding to one pixel and having a U-shaped core defined by a base portion connecting a first arm and a second arm, and wherein the first arm includes a first coil and the second arm includes a second, coil.

22. The watch display of claim 19, wherein at least one of the rotatable pixels includes a display face having an attached material selected from the group comprising crystal, or gemstone.

23. A watch display comprising:

a plurality of magnetically actuated flippers having a display face positioned within a surrounding background, the flippers rotating between a first orientation in which the display face has a first optical state and a second orientation in which the display face has a second different optical state, wherein one of the first optical state and the second optical state substantially matches the surrounding background; and at least one radially extending hand positioned above the flippers and the surrounding background, the hand being connected to an analog movement beneath the flippers and the surrounding background.

24. The watch display of claim 23, further comprising a plurality of electromagnets, wherein each electromagnet corresponds to one of the plurality of magnetically actuated flippers, and wherein each electromagnet includes a U-shaped core defined by a base portion connecting two armatures and each armature includes a coil.

25. The watch display of claim 24, wherein a first group of the array of pixels are configured to display an alphanumeric character, and wherein U-shaped cores are positioned beneath the first group in an interwoven configuration.

26. The watch display of claim 23, wherein the display face of at least one of the flippers includes an attached material selected from the group comprising crystal, or gemstone.

27. A magnetically actuated watch display, comprising:

a plurality of groups of flippers, each flipper including a permanent magnet and rotating about an axis to present a display face with an on state in a first orientation and an off state in a second orientation, wherein each flipper is positioned substantially within a background and portions of the background adjacent each flipper substantially match the display ace in the off state, and wherein each group of flippers are configured to collectively present an alphanumeric character when at least some of the plurality of flippers are oriented to present the display face in the on state;

a corresponding plurality of paired electromagnet coils wherein each pair of coils is on a corresponding pair of arms of one of a plurality of U-shaped cores, wherein the U-shaped cores are positioned in an interwoven configuration beneath each group of flippers.

28. The display of claim 27, wherein there is substantially no gap between a first coil corresponding to a first flipper and any adjacent coil corresponding to a different flipper.

29. The display of claim 27, wherein the alphanumeric character is an Arabic numeral formed with seven flippers, and wherein for each group of seven corresponding U-shaped cores a majority of adjacent U-shaped cores are rotated ninety degrees from one another.

30. The display of claim 27, wherein the interwoven configuration includes paired coils that each have a width less than half an axial length of the corresponding flipper, and wherein an axial length of the permanent magnet of the flipper is less than or equal to half the axial length of the flipper.

31. The display of claim 27, wherein the interwoven configuration includes paired coils that overlap at least a portion of the permanent magnet of the corresponding flipper, and wherein the paired coils do not overlap the permanent magnet of any flipper other than the corresponding flipper for which the paired coils actuate rotation.

32. The display of claim 27, wherein the background includes a plurality of simulated dot matrix panels and a plurality of grooves between at least some of the adjacent panels, and wherein each groove substantially mimics a gap between at least one of the rotatable pixels and the background.

33. The display of claim 32, wherein each groove is a dark line.

34. The display of claim 27, wherein the display face of at least one of the flippers includes at least one beveled edge.

35. The display of claim 27, wherein paired coils are positioned on a pair of armatures of a U-shaped core, and wherein the U-shaped cores are integrated into the same plane as a printed circuit board.

36. The display of claim 27, wherein each flipper includes a stop protruding from a side of the flipper, and wherein the stop is substantially hidden beneath the background.

37. The display of claim 27, wherein the flipper rotates approximately 180 degrees.

38. The display of claim 27, wherein the resistance of each coil is greater than 75 Ohms.

39. The display of claim 27, wherein at least one flipper by itself includes textual information on one or both display faces.

40. The display of claim 39, wherein a single flipper displays AM in the first orientation and PM in the second orientation.

41. The display of claim 27, wherein a bobbin is used to wrap at least one of the paired coils around a respective arm of a U-shaped core.

* * * * *